US006058559A

United States Patent [19]

Yoshimi et al.

[11] Patent Number: 6,058,559

[45] Date of Patent: May 9, 2000

[54] ELECTRIC VACUUM CLEANER

[75] Inventors: Kazuyoshi Yoshimi, Hyogo-ken; Isao Yoneda, Himeji; Naoki Suetsugu, Kasai, all of Japan

[73] Assignee: Sanyo Electric Co., Ltd., Osaka-Fu, Japan

[21] Appl. No.: 09/100,754

[22] Filed: Jun. 22, 1998

[30] Foreign Application Priority Data

Jun. 23, 1997 [JP] Japan ..... 9-166242

[51] Int. Cl.[7] ..... A47L 5/36

[52] U.S. Cl. ..... 15/328; 15/323; 15/335; 15/410

[58] Field of Search ..... 15/328, 335

[56] References Cited

U.S. PATENT DOCUMENTS

| | | | |
|---|---|---|---|
| 3,310,828 | 3/1967 | Clark et al. | 15/328 |
| 4,393,536 | 7/1983 | Tapp . | |
| 4,443,910 | 4/1984 | Fitzwater . | |
| 4,573,236 | 3/1986 | Dyson . | |
| 5,054,157 | 10/1991 | Werner et al. | 15/328 |
| 5,287,591 | 2/1994 | Rench et al. | 15/328 |
| 5,715,566 | 2/1998 | Weaver et al. | 15/328 X |
| 5,836,047 | 11/1998 | Lee et al. | 15/328 |
| 5,842,254 | 12/1998 | Lee | 15/328 X |

*Primary Examiner*—Chris K. Moore
*Attorney, Agent, or Firm*—Sughrue, Mion, Zinn, Macpeak & Seas, PLLC

[57] ABSTRACT

An electric vacuum cleaner comprising a vacuum cleaner body, a hose to be connected to the vacuum cleaner body, a support pipe to be connected to the hose, and a suction device to be connected to the support pipe. The suction device is provided with running wheels, and the vacuum cleaner body is able to be detachably fastened to the support pipe so that it is supported by the wheels of the suction device when the vacuum cleaner body is attached to the support pipe. The cleaning workability is thus improved, and the external appearance of the vacuum cleaner body in a condition of being detached from the support pipe can be improved.

19 Claims, 20 Drawing Sheets

ELECTRIC VACUUM CLEANER

BACKGROUND OF THE INVENTION

The present invention relates to an electric vacuum cleaner.

An electric vacuum cleaner which is transformable depending on places to be cleaned is disclosed in Japanese Unexamined Utility Model Publication No. 80455/1992, wherein the electric vacuum cleaner is of concurrent type which can be used in an upright condition for use by fastening a vacuum cleaner body to a support pipe in a attachable/detachable manner and which can also be used in a condition where the vacuum cleaner body is detached from the support pipe.

Such a conventional concurrent type vacuum cleaner comprises, as shown in FIG. 21, a vacuum cleaner body 31, a hose 40, a support pipe 32, a rotary bend 33 and a suction device 34. By sequentially connecting these components, there is achieved a condition where the vacuum cleaner body is detached from the support pipe wherein the vacuum cleaner body 31 and the support pipe 32 are separated.

The rotary bend 33 is connected to the suction device 34 (or a rotary pipe (not shown) connected to this suction device 34) in a rotatable manner.

Further, by fitting projections 36 provided on the outer surface of the support pipe 32 to concave portions 35 formed on the lower surface of the vacuum cleaner body 31, the lower surface of the vacuum cleaner body 31 can be fastened to the support pipe 32, whereby the vacuum cleaner can be transformed into an upright condition for use as shown in FIG. 21. When assuming the upright condition for use, the vacuum cleaner body 31 is leaning against the support pipe 32 and abuts onto the suction device 34. In the upright condition for use, the hose 40 is so arranged that the upper end thereof is connected to a position substantially below a grip 37 in the rear side of the support pipe 32, an intermediate portion thereof is winding from the side of the support pipe 32, and the lower end thereof is connected to the vacuum cleaner body 31 in the front side of the support pipe 32. It should be noted that 31*a* denotes a portion at which rear wheels 38 at a rear portion of the lower end of the vacuum cleaner body 31 are provided.

There are formed at least two concave portions 35 on the lower surface of the vacuum cleaner body 31 along a front and rear direction of the vacuum cleaner body 31, and a plurality of projections 36 are provided along a vertical direction of the support pipe 32 so as to correspond to the respective concave portions 35.

However, according to this conventional art, the front and rear wheels of the suction device and the rear wheels of the vacuum cleaner body contact the ground in the upright condition for use. Since six wheels simultaneously contact the ground in this arrangement, change in running directions when performing cleaning operation is hard to be made, whereby the cleaning workability is made poor. It is further presented a drawback, in a condition where the vacuum cleaner body is detached from the support pipe, that the rear wheels of the vacuum cleaner body largely project rearward and look unattractive.

A conventional vacuum cleaner is also arranged in such a manner that the rotary bend 33 can be rotated with respect to the suction device 34 in the upright condition for use. In addition, the center of gravity of the vacuum cleaner body 31 attached to the upper surface of the support pipe 32 is located above a rotating axis (that is, a position corresponding to a central axis of a connecting portion 39 of the rotary bend 33 and suction device 34).

Therefore, when the support pipe 32 and rotary bend 33 are slightly inclined to a vertical direction in FIG. 21 as to rotate with respect to the suction device 34, continuous force in a rotating direction is applied to an users hand holding the grip 37 in the upper portion of the support pipe 32 and is thus quite unstable which also leads to poor workability.

On the other hand, while this problem can be solved by an arrangement in which the rotary bend 33 is preliminarily fastened to the suction device 34 so that it cannot rotate, such an arrangement would limit the sphere of usage and be undesirable, since, for instance, the suction device 34 can no longer be inserted into narrow spaces such as under a bed in which the rotary bend 33 is in a condition where it is rotated so as to be parallel to the floor surface with the vacuum cleaner body being detached from the support pipe.

The conventional electric vacuum cleaner of FIG. 21 also presents a drawback that it is difficult to fix the vacuum cleaner to the support pipe since the plurality of projections 36 aligned in the upper and lower ends of the vacuum cleaner body need to be simultaneously fitted to the concave portions 35.

Further, during the detaching process, the vacuum cleaner body 31 might loose its stability in a case where only the projection 36 on the lower side is fitted to the concave portion 35, since the front side of the vacuum cleaner body 31 would then not be fixed to the support pipe 32.

A conventional vacuum cleaner in its upright condition for use is so arranged that a portion in the proximity of the upper end of the hose 40 projects from below the grip 37 to rearward of the support pipe 32. This arrangement presents a drawback in that the vacuum cleaner body is hard to use since the hose 40 contacts the user in a rubbing manner.

The present invention has been made in view of solving these problems, and it is an object of the present invention to provide an electric vacuum cleaner having improved cleaning workability and a vacuum cleaner body of improved external appearance when it is detached from the support pipe.

It is further an object of the present invention to provide an electric vacuum cleaner which can be easily operated in an upright condition for use by preventing the rotary bend which receives the load of the vacuum cleaner body from rotating relative to the rotary pipe at a side of the suction device, and moreover, of which sphere of usage is not limited by permitting rotation in a condition where the vacuum cleaner body is detached from the support pipe.

It is also an object of the present invention to provide an electric vacuum cleaner of which vacuum cleaner body can be easily attached to/detached from the support pipe.

It is another object of the present invention to provide an electric vacuum cleaner in which the stableness of the vacuum cleaner body during the attaching/detaching process is improved.

It is still another object of the present invention to provide an electric vacuum cleaner in which the hose in the upright condition for use can be smoothly operated without contacting the user.

SUMMARY OF THE INVENTION

In accordance with the present invention, there is provided an electric vacuum cleaner comprising a vacuum cleaner body, a hose to be connected to the vacuum cleaner body, a support pipe to be connected to the hose, and a suction device to be connected to the support pipe, wherein the suction device is provided with running wheels, and the vacuum cleaner body is able to be detachably fastened to the support pipe so that it is supported; by the wheels of the suction device when the vacuum cleaner body is attached to the support pipe.

In accordance with the present invention, there is further provided an electric vacuum cleaner comprising a vacuum cleaner body, a hose to be connected to the vacuum cleaner body, a support pipe to be connected to the hose, a rotary pipe to be connected to the support pipe in a rotatable manner, and a suction device to be connected to the rotary pipe, wherein the vacuum cleaner body is arranged such that the vacuum cleaner body can be fastened to the support pipe in a detachable manner and wherein the electric vacuum cleaner is provided with a rotation regulating means for preventing rotation of the rotary pipe with respect to the support pipe when the vacuum cleaner body is attached to the support pipe.

In accordance with the present invention, there is also provided an electric vacuum cleaner of the present invention comprising:

(a) a vacuum cleaner body, (b) a support pipe connected to a suction inlet of the vacuum cleaner body, (c) a rotary bend connected to the support pipe, (d) a rotary pipe connected to the rotary bend in a rotatable manner, and (e) a suction device connected to the rotary pipe, wherein the vacuum cleaner body is attached to the support pipe in a attachable/detachable manner, and wherein the electric vacuum cleaner further includes a rotation locking means for locking rotation of the rotary bend with respect to the rotary pipe when the vacuum cleaner body is attached to the rotary pipe at a specified position.

The rotation locking means preferably comprises a flat portion formed on the vacuum cleaner body, a flat portion formed on the rotary bend, and a flat portion formed on the rotary pipe.

It is preferable that at least a part of the flat portion of the rotary bend and the flat portion of the rotary pipe is so formed as to project from a circumferential surface of the rotary bend or rotary pipe along a tangential direction of the circumferential surface.

The rotation locking means preferably comprises projections formed on the rotary bend and the rotary pipe, and concave portions formed on the vacuum cleaner body for fitting with the projections.

In accordance with the present invention, there is still further provided an electric vacuum cleaner comprising a vacuum cleaner body, a hose to be connected to the vacuum cleaner body, a support pipe to be connected to the hose, and a suction device to be connected to the support pipe, wherein the support pipe is provided with a first engaging portion which detachably engages with a first receiving portion formed in a rear portion of the vacuum cleaner body, and a second engaging portion which detachably engages with a second receiving portion formed in a front portion of the vacuum cleaner body.

The second engaging portion of the support pipe is preferably movable up and down.

It is preferable that a tip portion of the second engaging portion of the support pipe is formed with a slanting surface that is inclined in an upward direction with receding from the support pipe.

It is preferable that the electric vacuum cleaner includes an energizing means that energizes the second engaging portion of the support pipe in a downward direction.

In accordance with the present invention, there is yet further provided an electric vacuum cleaner comprising a vacuum cleaner body, a hose to be connected to the vacuum cleaner body, a support pipe to be connected to the hose, and a suction device to be connected to the support pipe, wherein the vacuum cleaner body is detachably fastened to a front of the support pipe, and wherein the hose is connected to the vacuum cleaner body and the hose in the front of the support pipe.

It is preferable that at least a part of an upper portion of the support pipe is bent to the front side of the support pipe, and an opening is formed at the upper end of the bent portion of the support pipe.

It is preferable that a grip is fastened to a rear side of the bent portion of the support pipe.

Since the electric vacuum cleaner of the present invention is provided with running wheels at its suction device and the vacuum cleaner body is made to run by the wheels of the suction device in a condition where the vacuum cleaner body is attached to the support pipe, the cleaning workability is favorable.

Since the electric vacuum cleaner of the present invention includes a rotation locking means for locking rotation of the rotary bend with respect to the rotary pipe, the rotation locking means locks the rotation between the rotary pipe and rotary bend by making the vacuum cleaner body abut against the rotary pipe at a specified position when transforming to the upright condition for use. Therefore, the support pipe and the rotary bend cannot be inclined as to rotate with respect to the suction device. Accordingly, no force in a rotating direction is applied to an users hand holding the grip at the upper portion of the support pipe.

When transforming to the condition where the vacuum cleaner body is detached from the support pipe, rotation locking condition between the rotary pipe and the rotary bend can be released by simply separating the vacuum cleaner body from the rotary pipe at the specified position Therefore, the rotary bend can be rotated so as to be parallel with respect to the floor surface so that the suction device is inserted into a narrow space such as under a bed in a condition where the vacuum cleaner body is detached from the support pipe.

The electric vacuum cleaner of the present invention is so arranged that concave portions are formed at end portions in the front and rear of the vacuum cleaner body, and on the other hand, convex portions are formed at the support pipe and the like corresponding to the concave portions, as to be aligned in a vertical direction, and as to be opposing to each other (i.e. downward facing convex portion being positioned above upward facing convex portion). Moreover, the downward facing convex portion of the support pipe is movable up and down.

By these characteristics, it has been enabled in the electric vacuum cleaner of the present invention, when being transformed to the upright condition for use, that the downward facing concave portion at the rear end of the vacuum cleaner body is made to fit to the upward facing convex portion formed, for instance, at the support pipe, and thereafter, the upward facing concave portion at the front end of the vacuum cleaner body is made to fit to the downward facing convex portion of the support pipe which might, for instance, be a clamping hook. Vice versa, when detaching the vacuum cleaner body from the support pipe, the above-described processes are performed in a reverse manner.

Therefore, fitting and separation of the concave portions and convex portions can be sequentially performed point by point.

When the downward facing convex portion comprising a clamping hook is pushed up for detaching the vacuum cleaner body from the support pipe, the vacuum cleaner body is likely to tumble in a direction apart from the support pipe with a position at which the concave portion at the rear end fits with the upward facing convex portion being as a fulcrum. In this case, the additional provision of the hose connecting the vacuum cleaner body and the support pipe and arrangement of a hose retainer for fixing the hose at a higher position than the downward facing convex portion of the support pipe would fix the vacuum cleaner body to the support pipe through the hose and the hose retainer, whereby tumbling of the vacuum cleaner body can be prevented.

The electric vacuum cleaner of the present invention is further designed so that the electric vacuum cleaner body and the upper end opening of the support pipe are arranged on the front side of the support pipe, and that the hose connecting the electric vacuum cleaner body and the upper end opening is arranged in the front of the support pipe over its full length. Therefore, the electric vacuum cleaner can be easily used in the upright condition for use, since the hose will not contact the user who is in the rear side of the support pipe.

BRIEF EXPLANATIONS OF THE DRAWINGS

Figure 1:
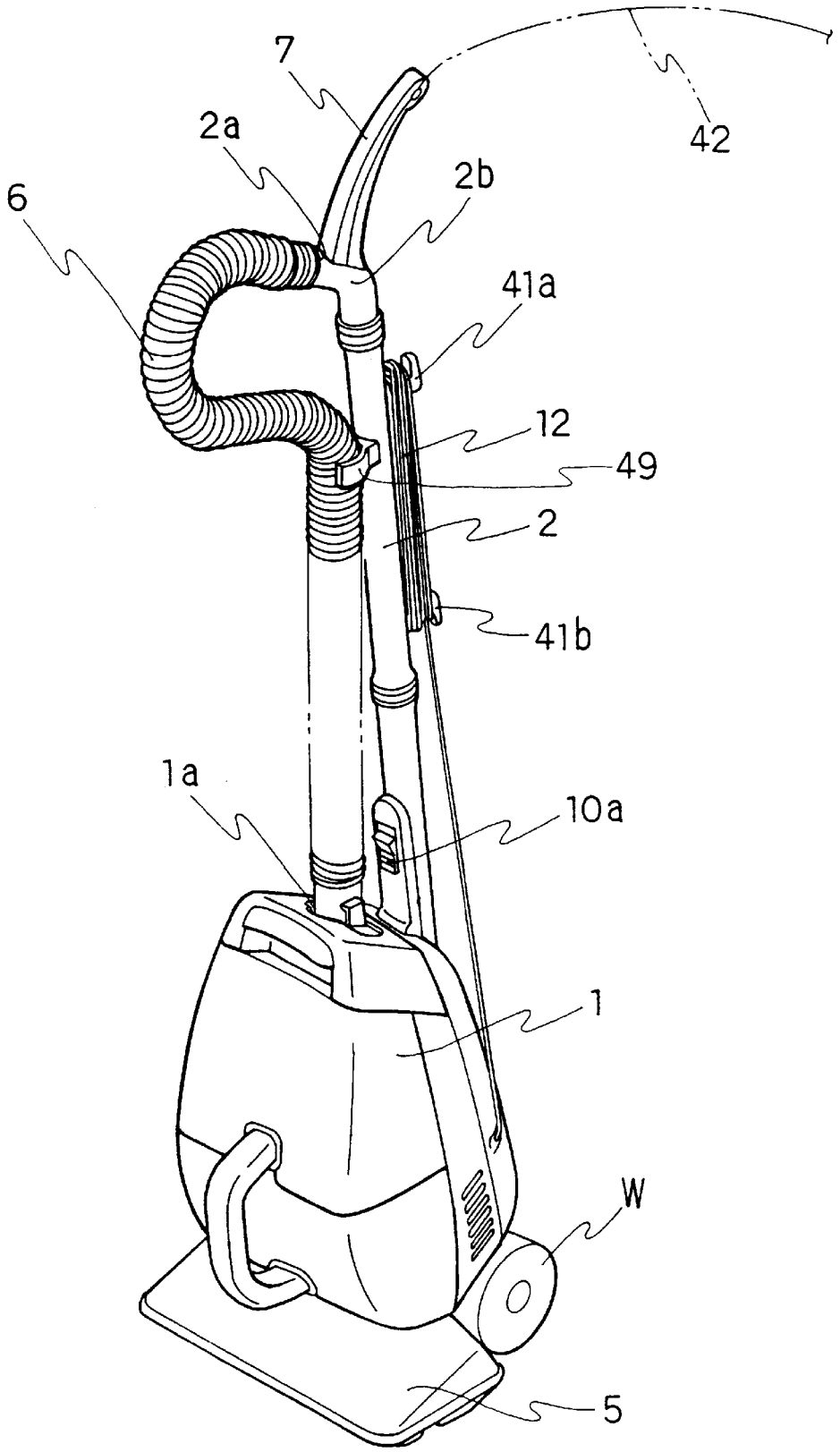
FIG. 1 is a perspective, explanatory view showing an electric vacuum cleaner in an upright condition for use according to one embodiment of the present invention.
Figure 4:
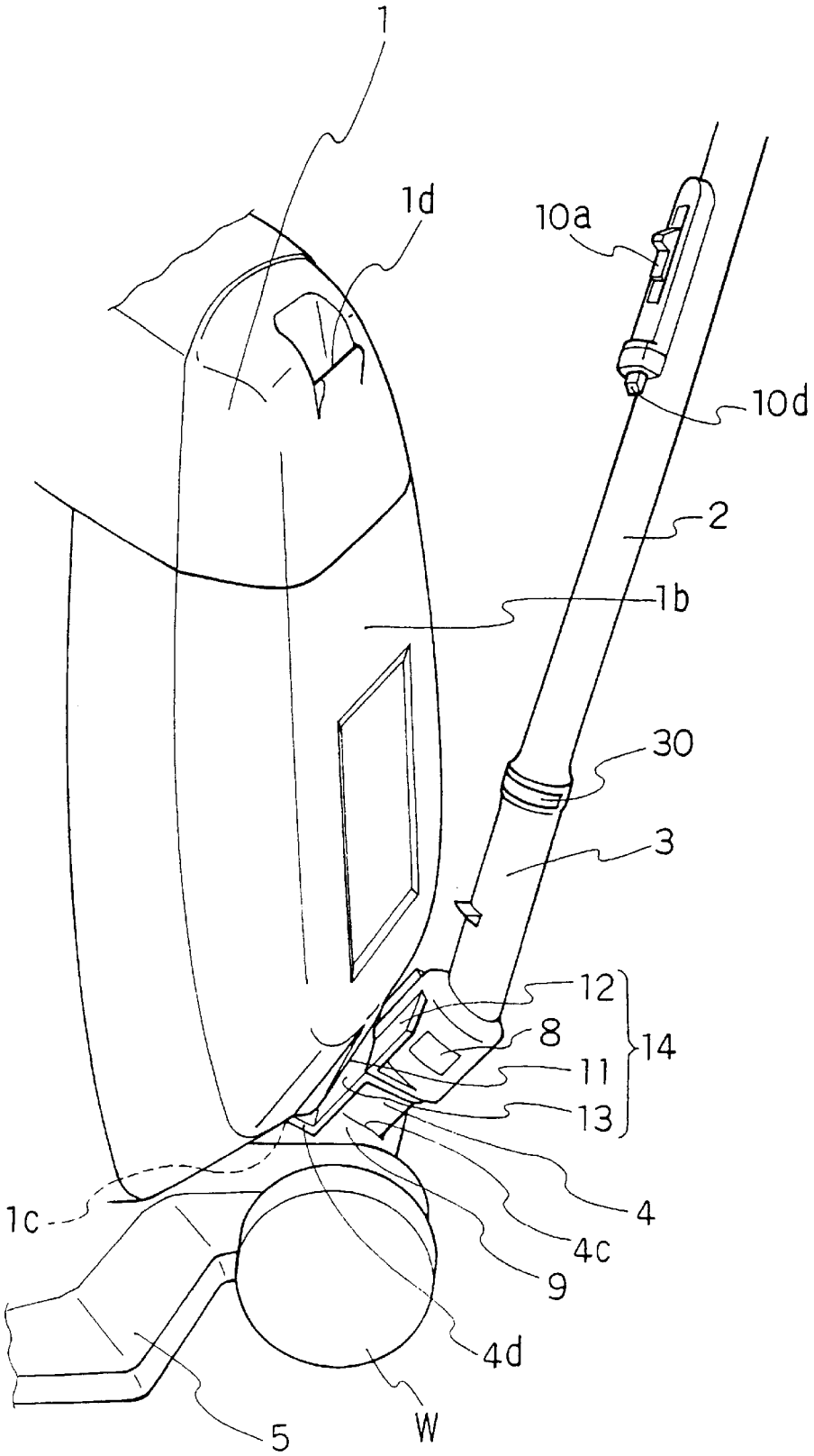
FIG. 4 is a perspective, explanatory view showing a condition of the electric vacuum cleaner of FIG. 1 during transformation to the upright condition for use.
Figure 5A:
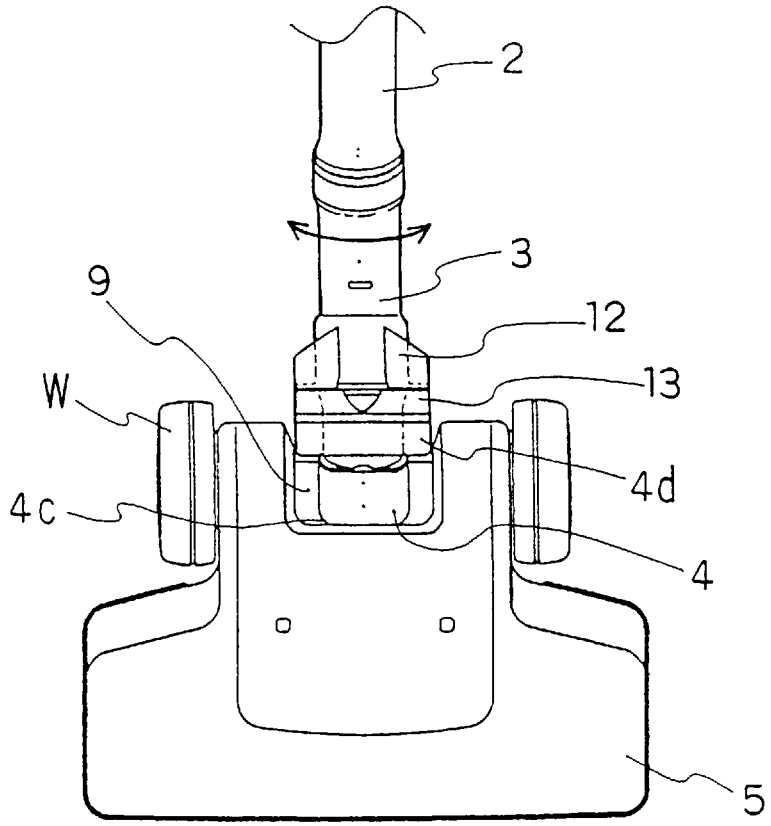
Figure 5B:
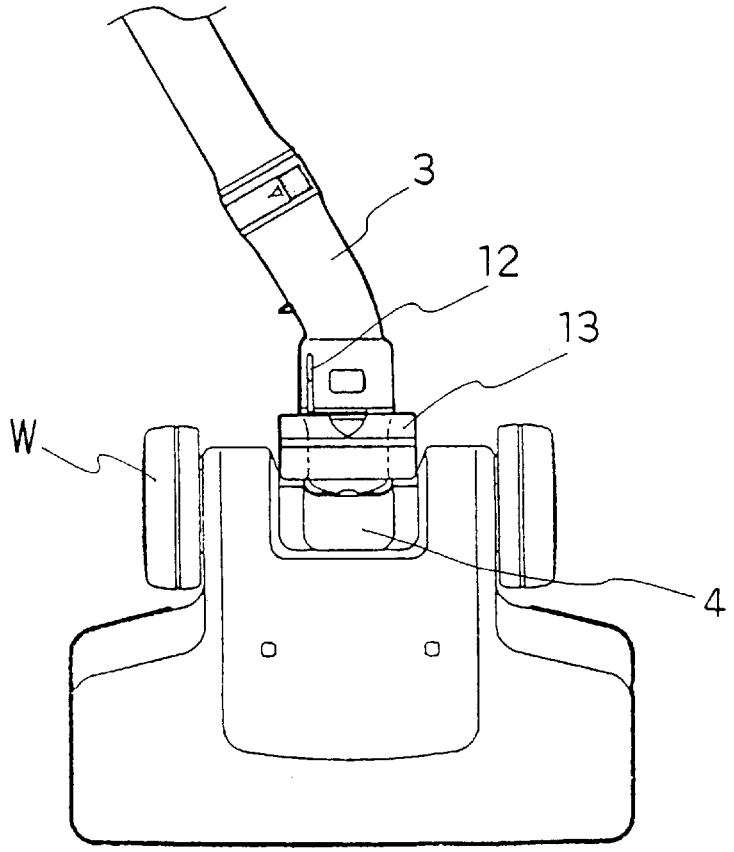
Figure 6:
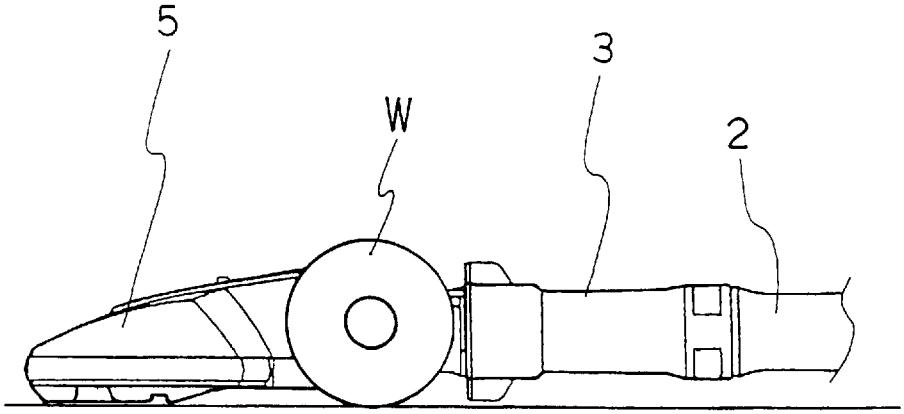
Figure 7:
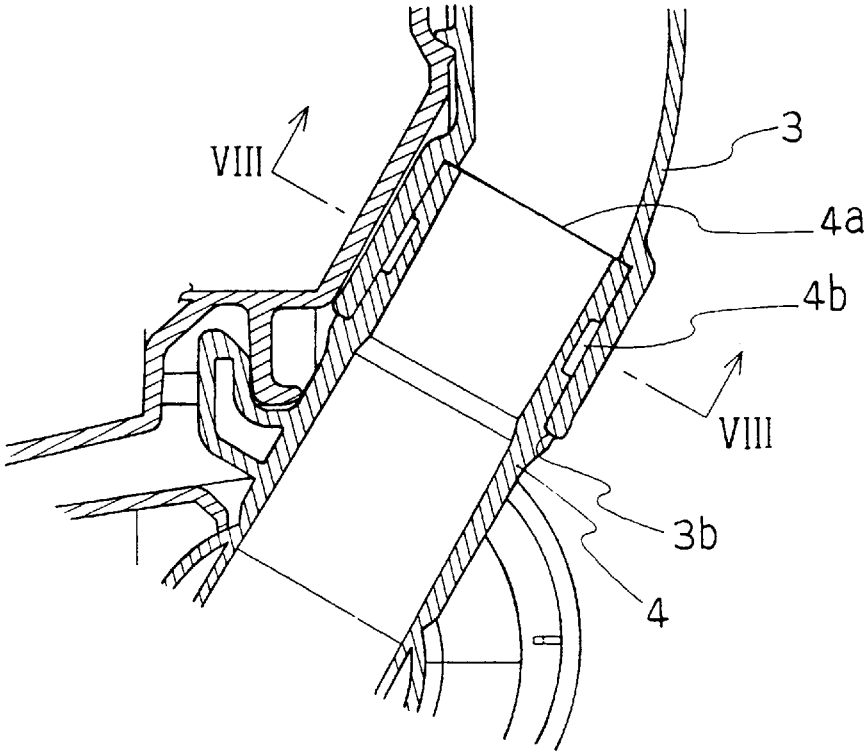
Figure 8A:
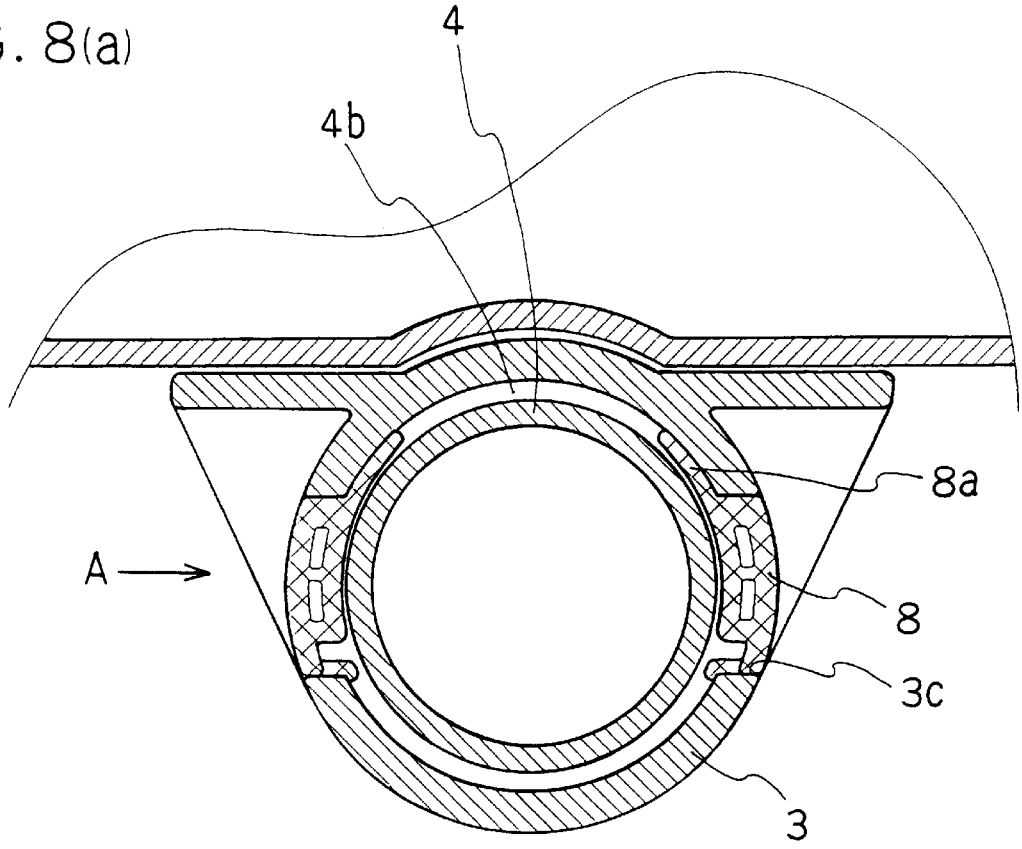
Figure 8B:
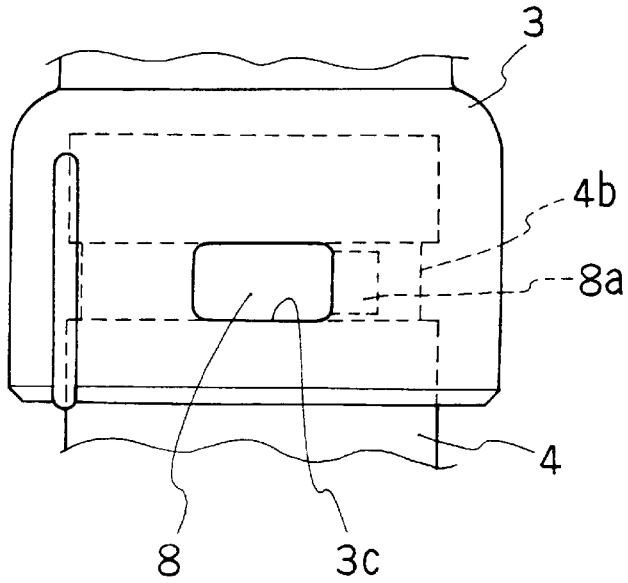
Figure 9:
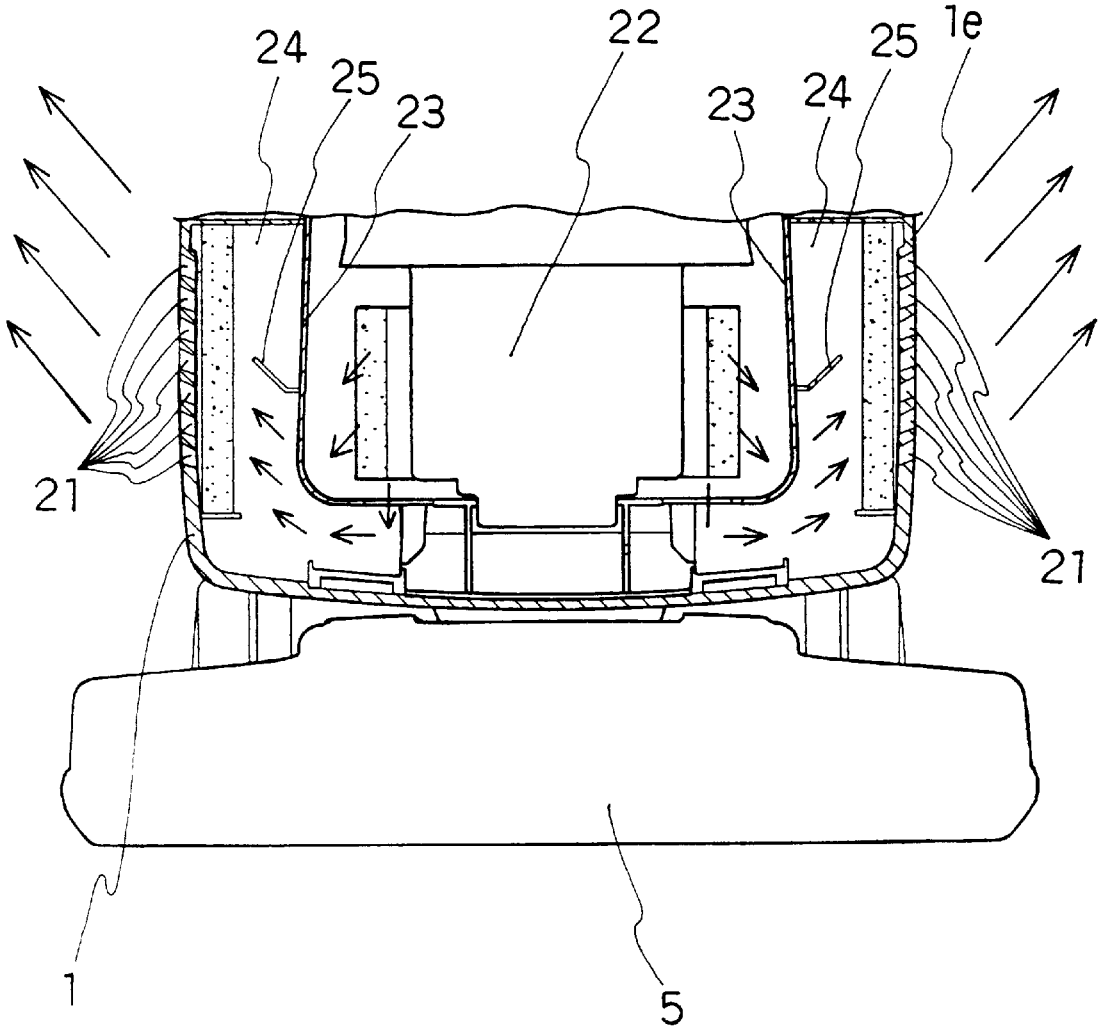
Figure 10:
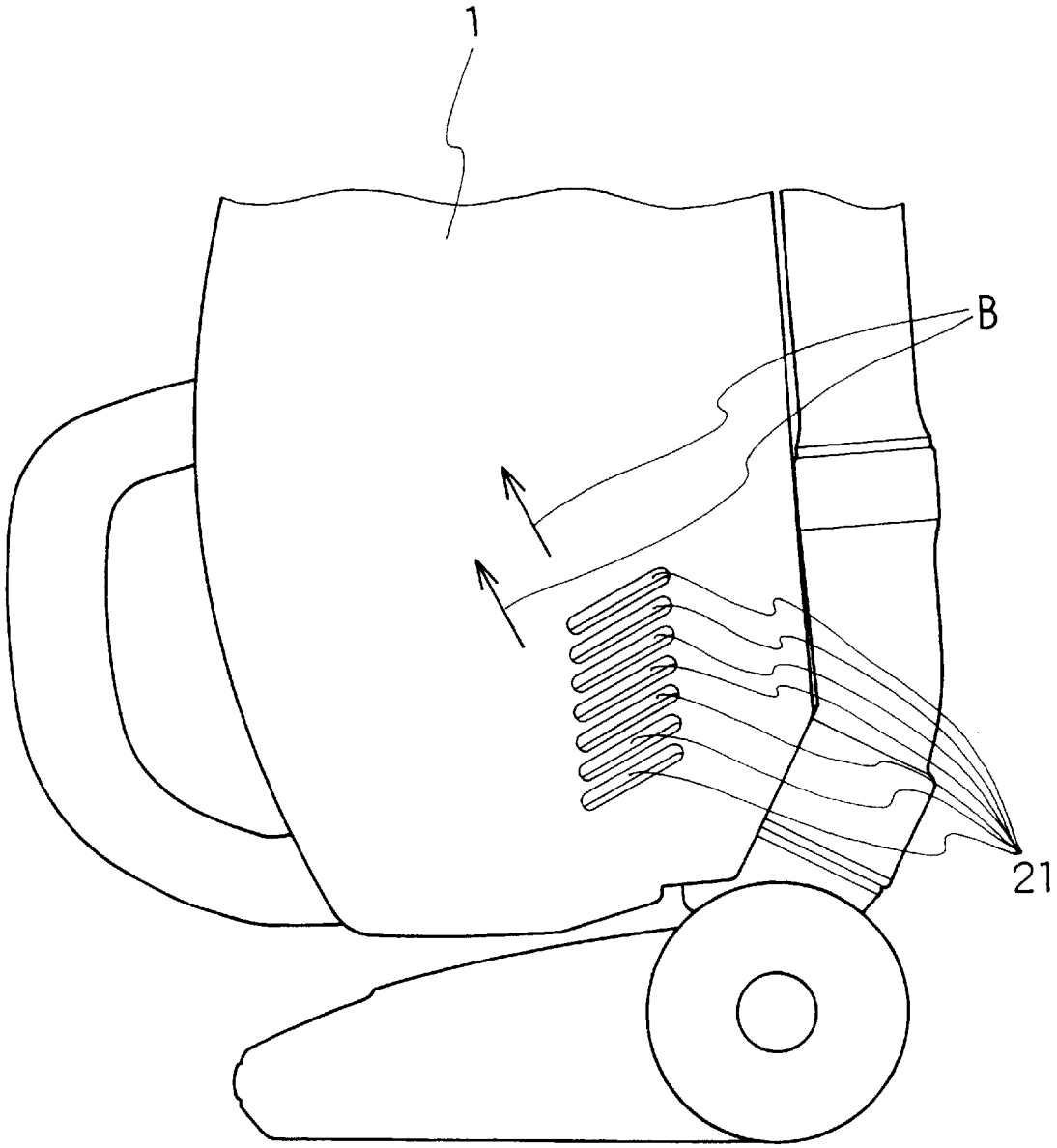
Figure 11:
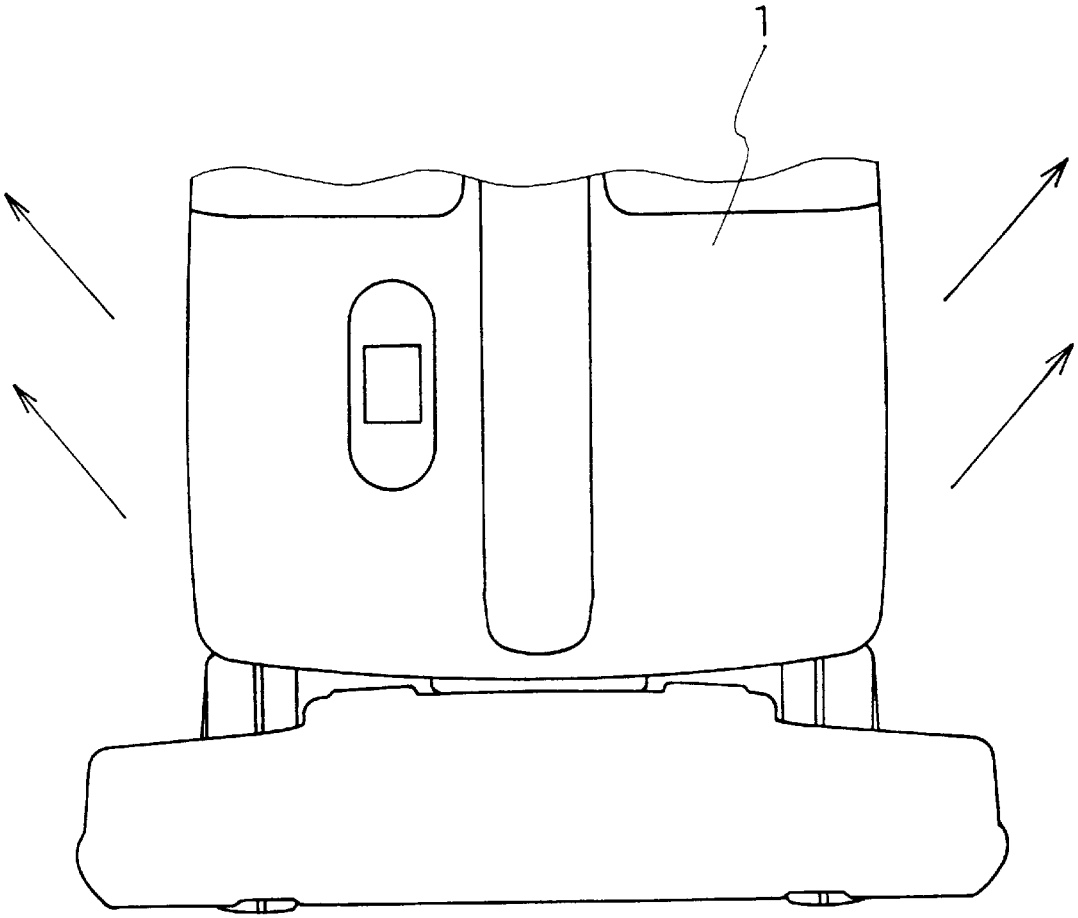
Figure 12:
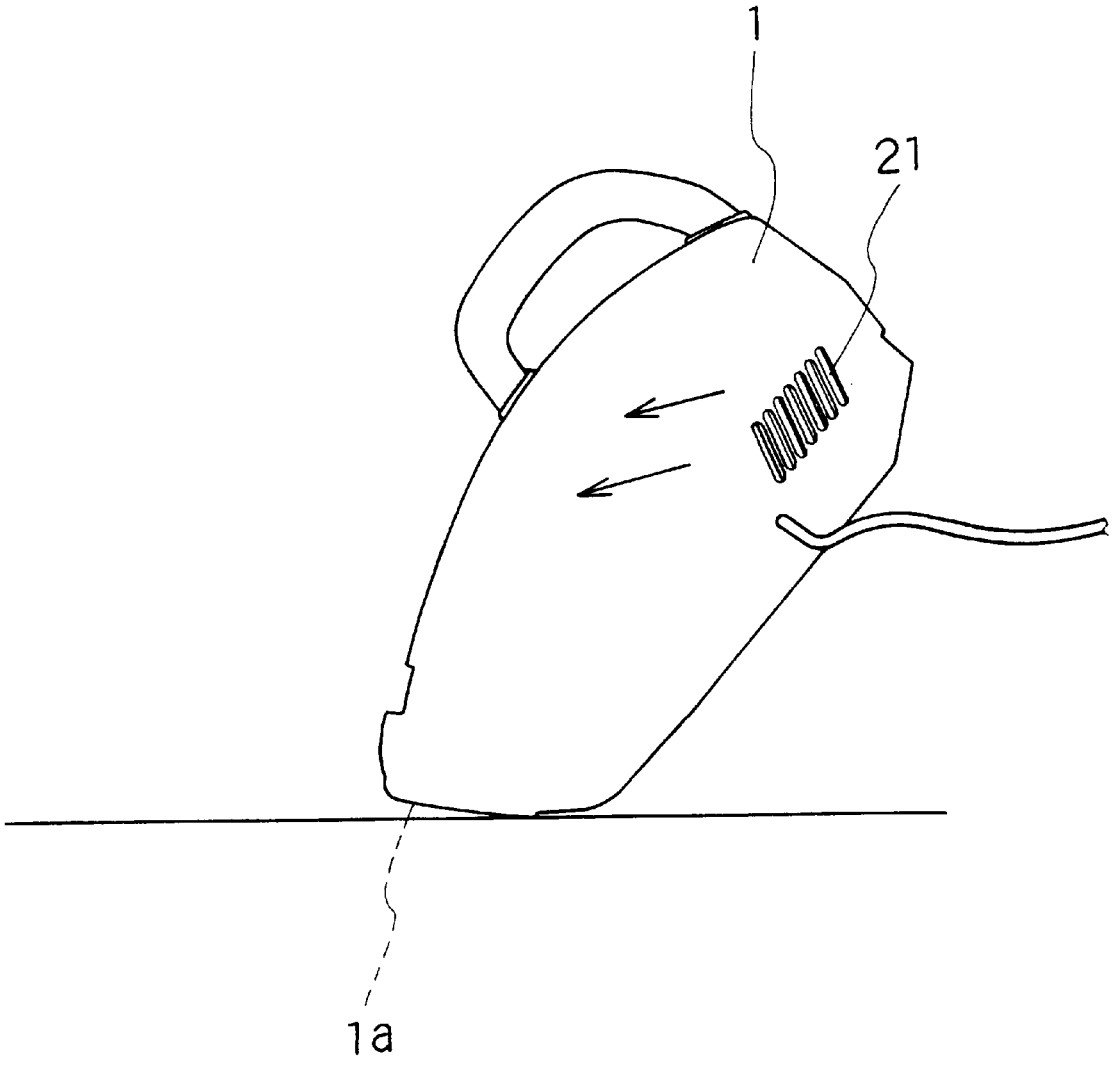
Figure 13:
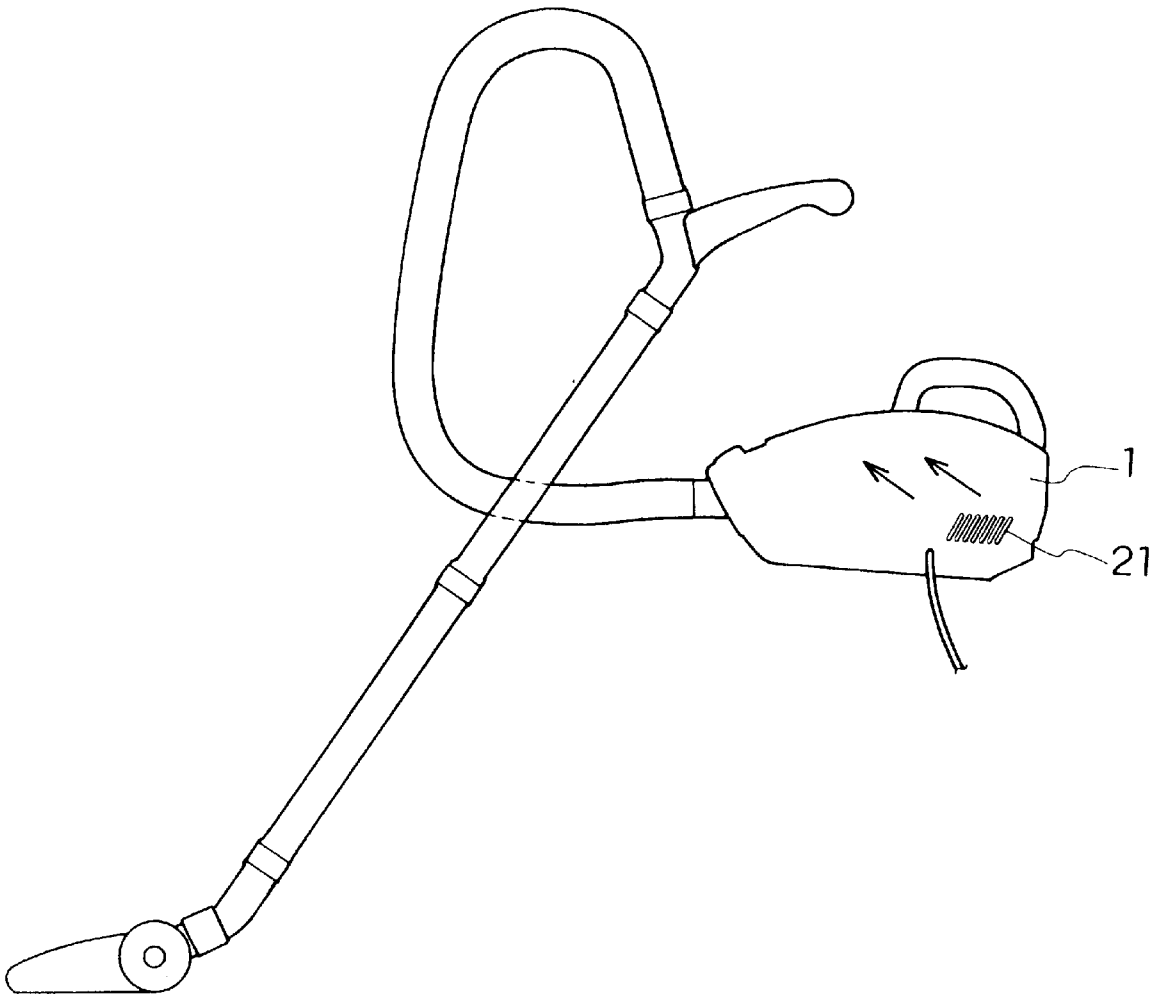
Figure 14A:
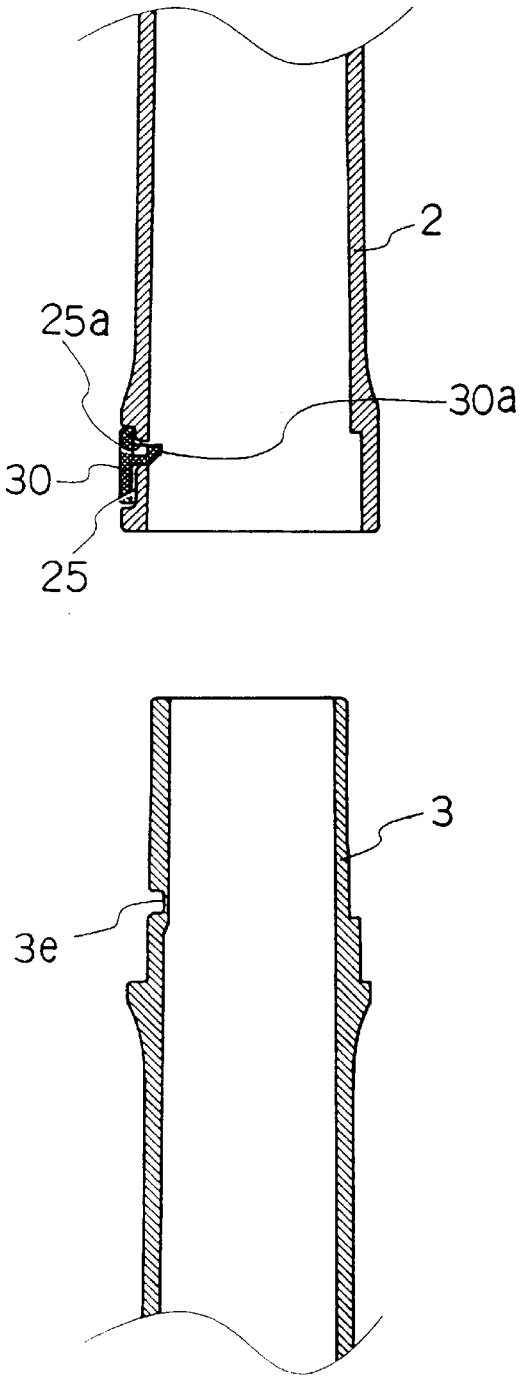
Figure 14B:
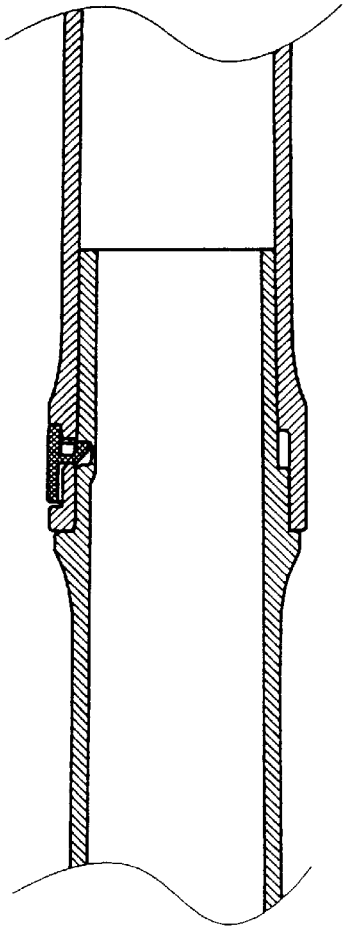
Figure 15A:
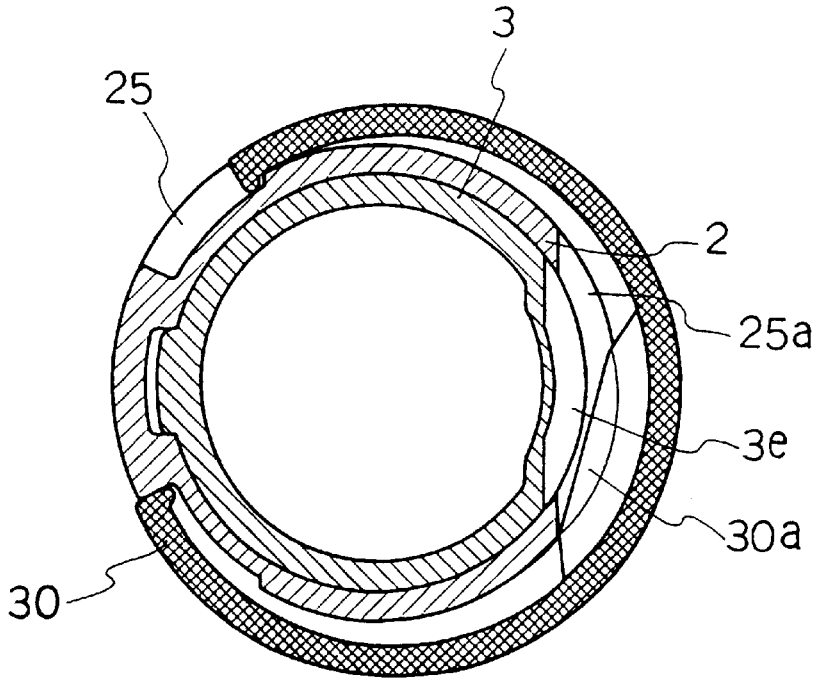
Figure 15B:
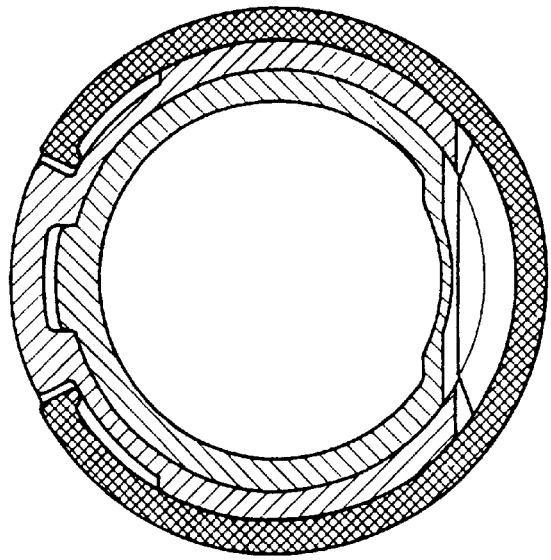
Figure 16:
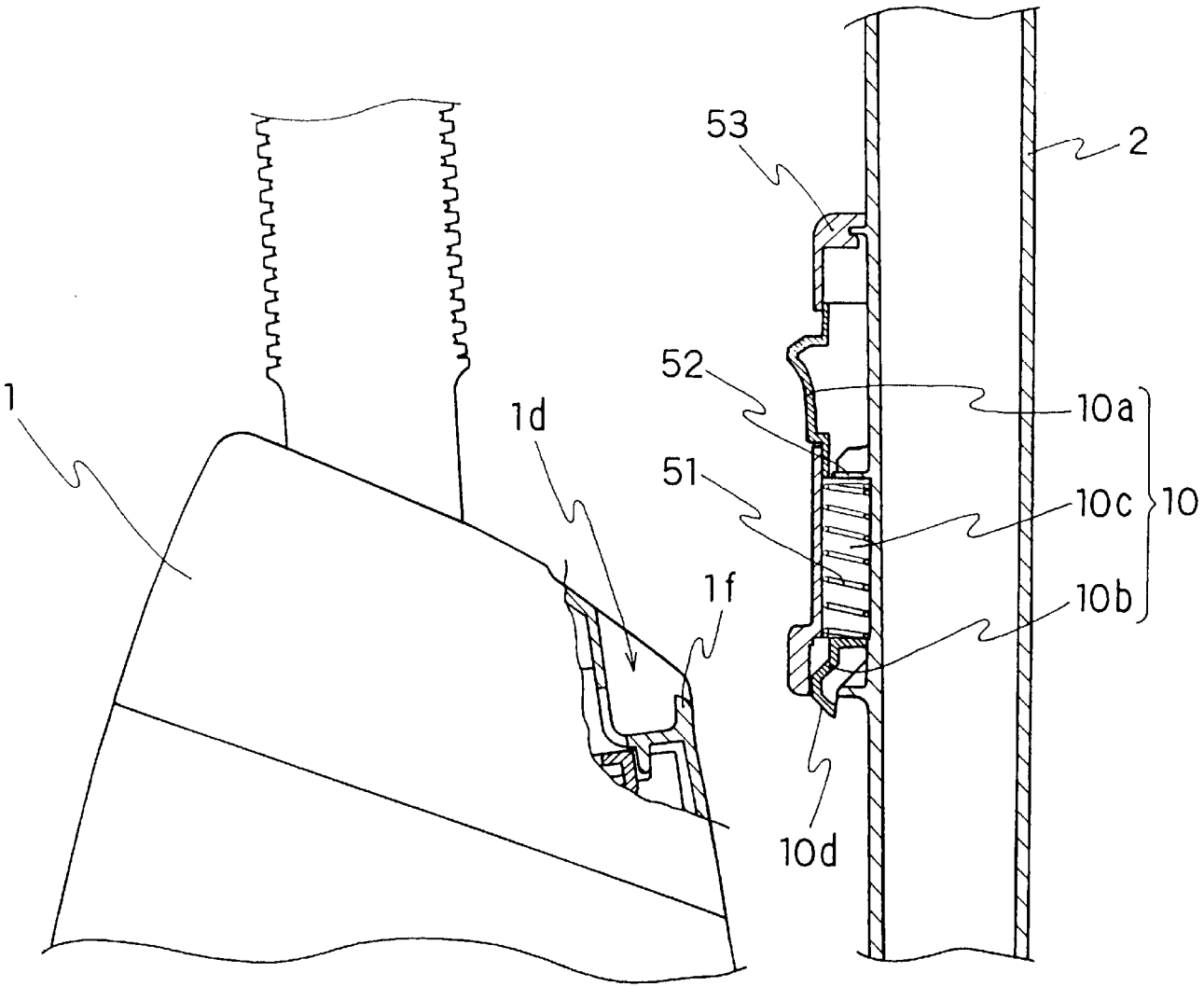
Figure 17:
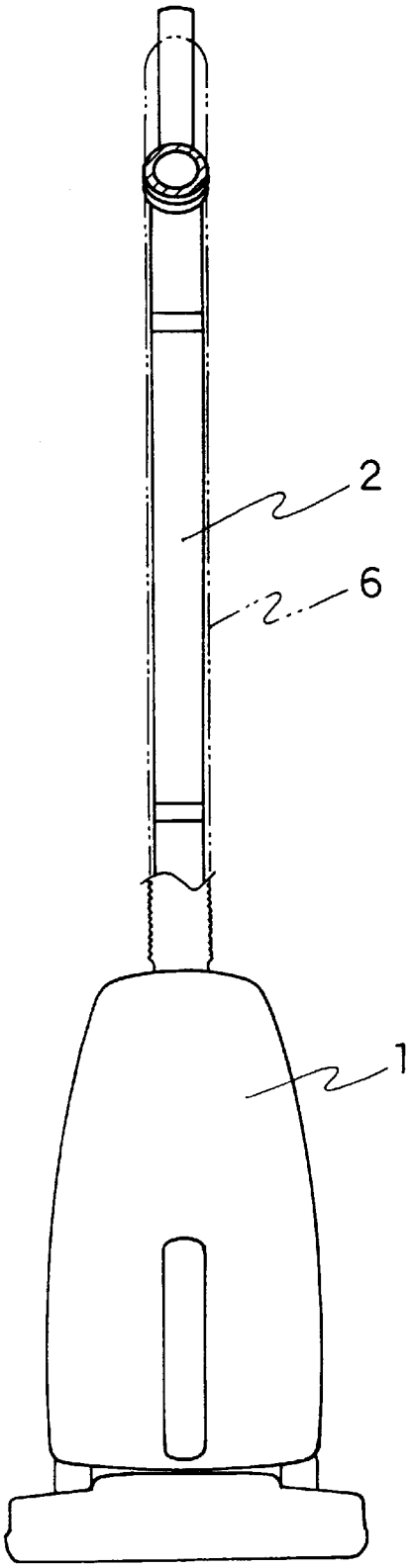
Figure 18:
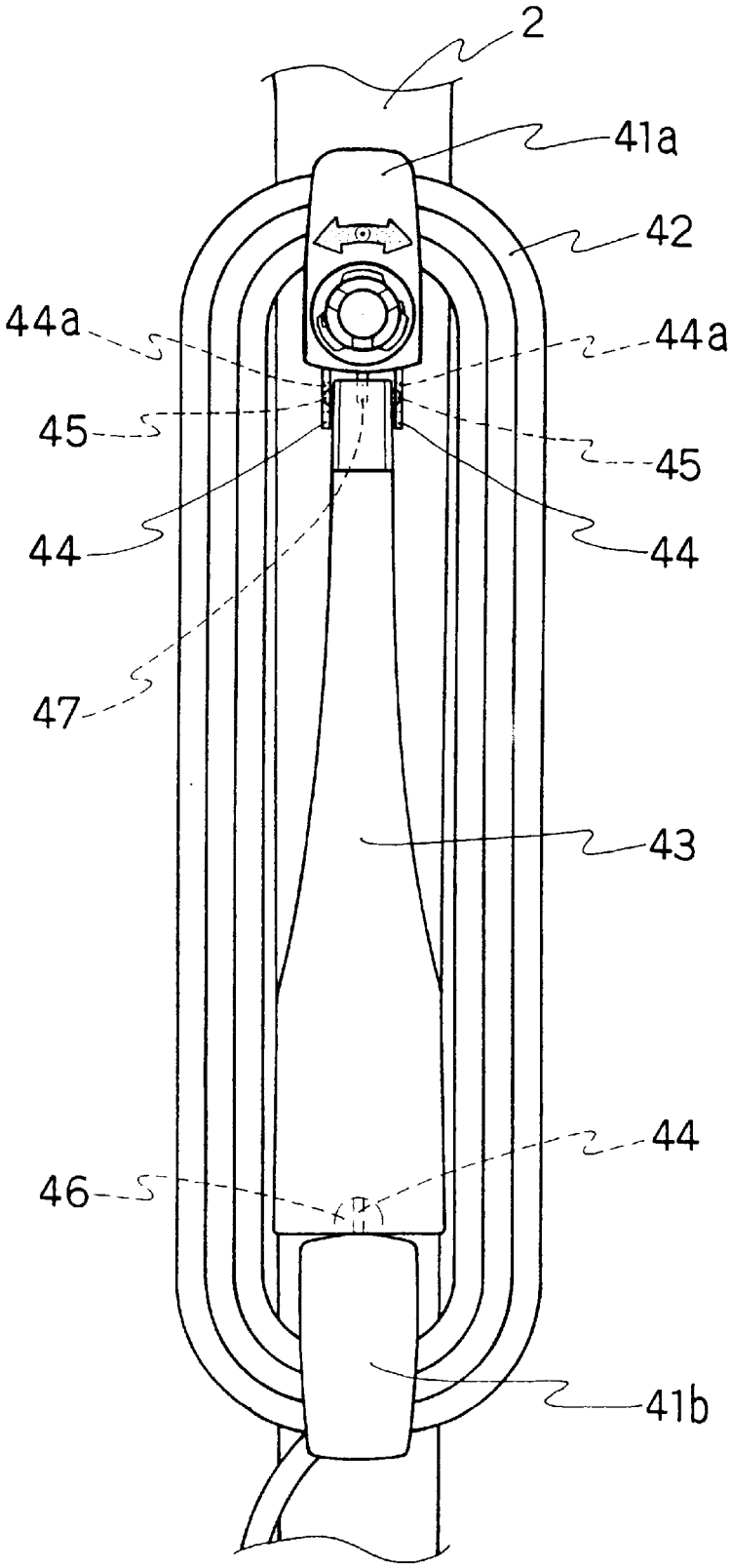
Figure 19:
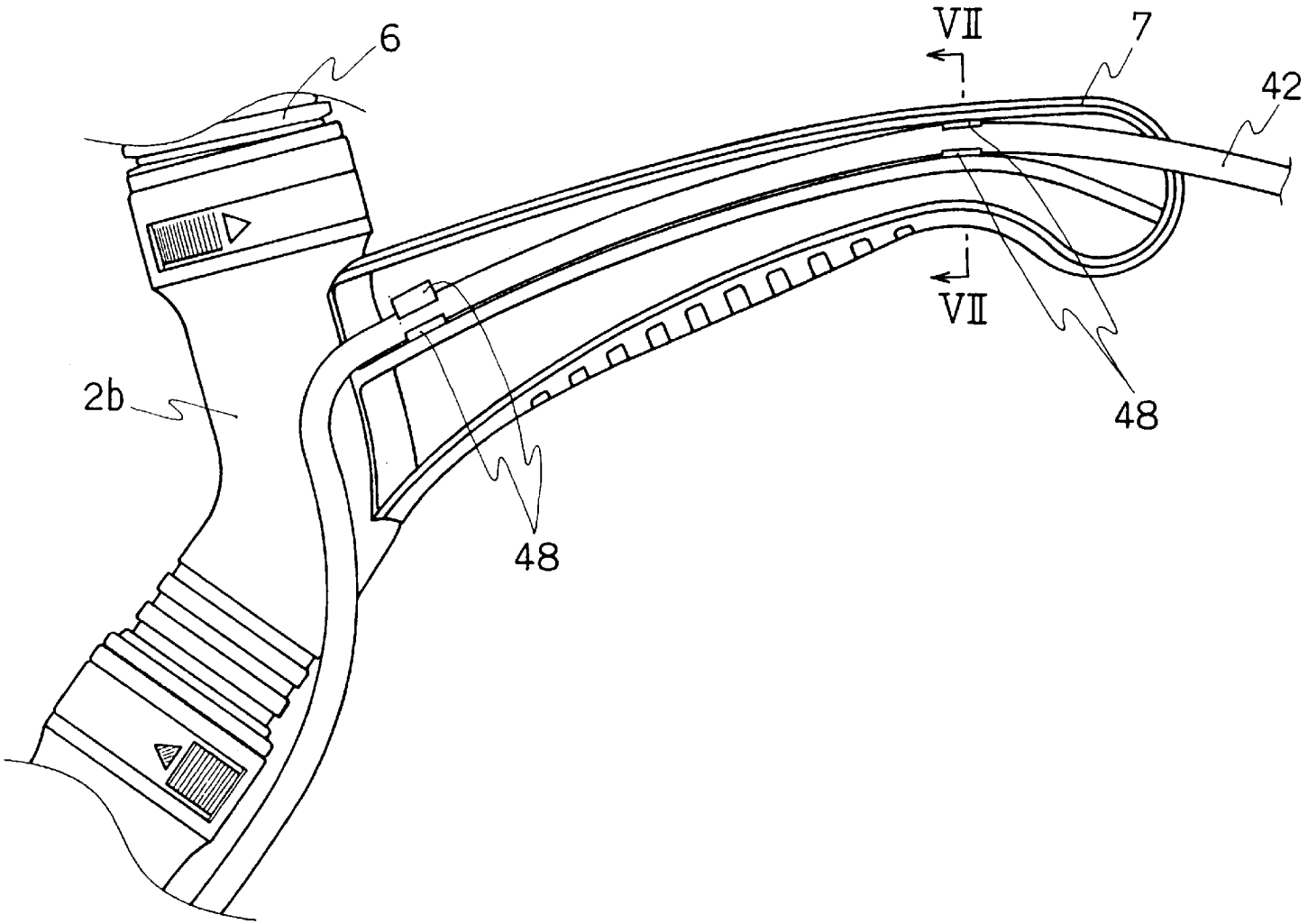
Figure 20:
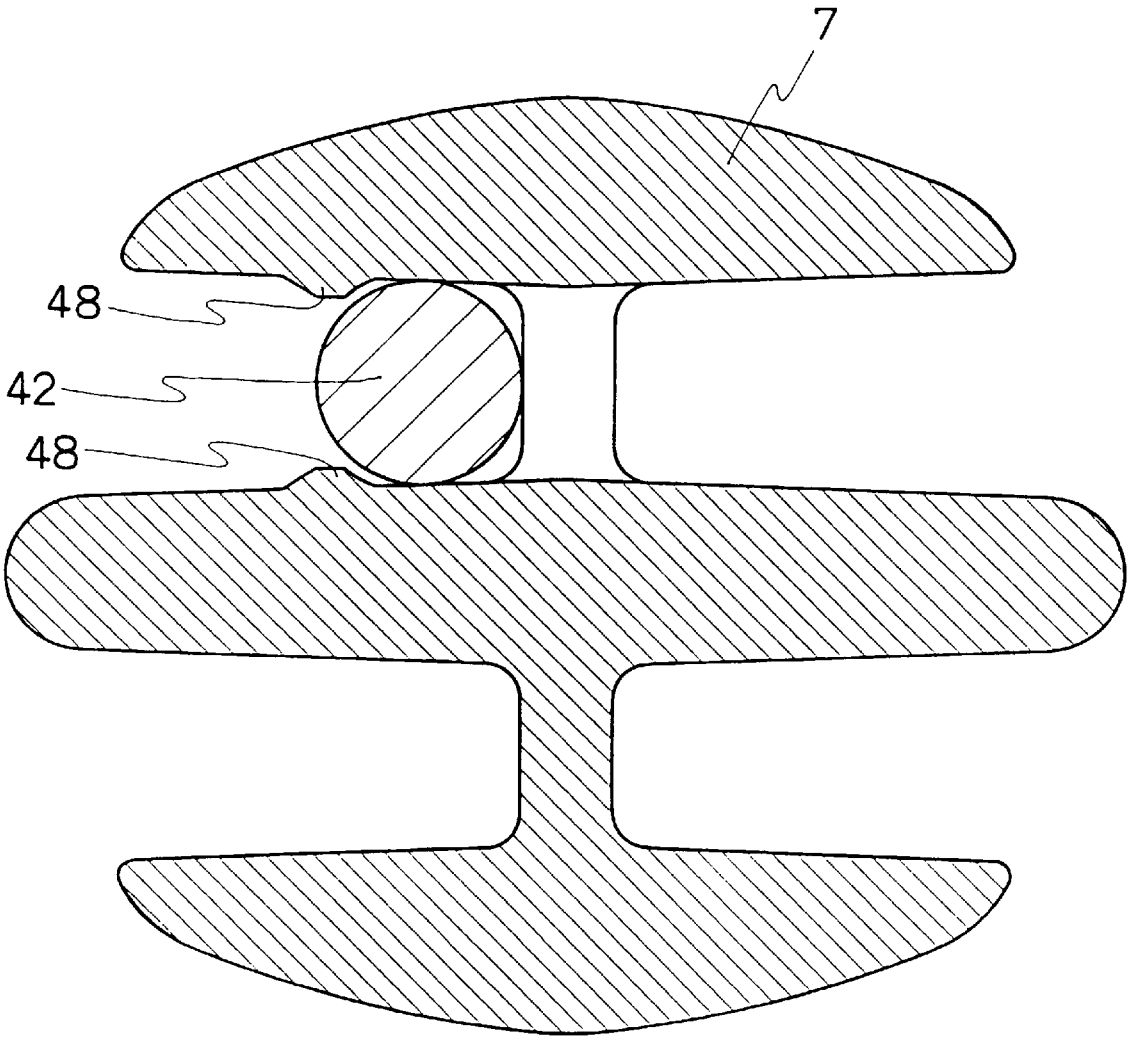
Figure 21:
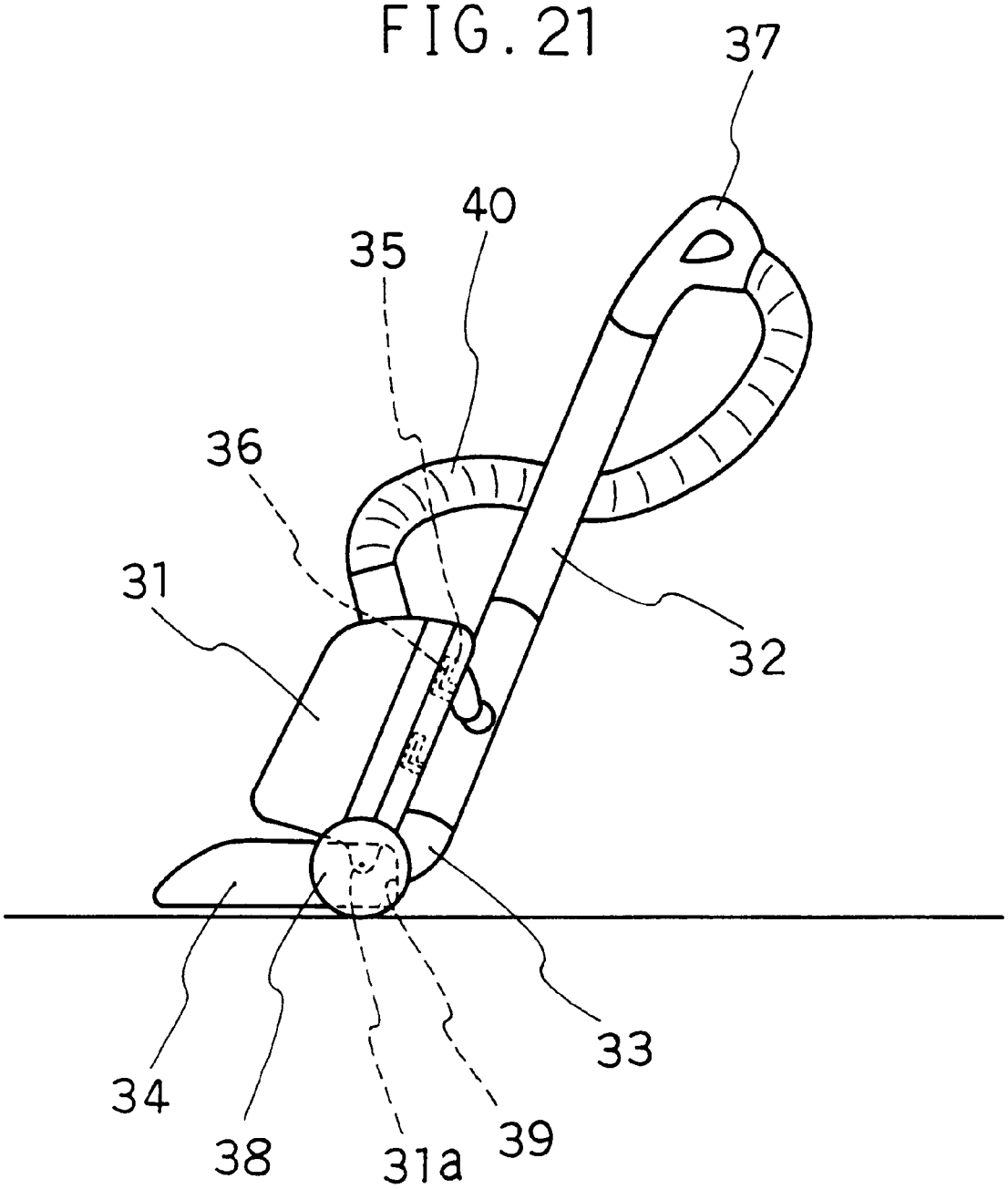

FIGS. 5(*a*) and 5(*b*) are a plan, explanatory views showing a positional relationship between the rotary bend and the rotary pipe of FIG. 4;

FIG. 6 is a partially enlarged, side view showing a condition where the rotary bend of FIG. 4 is rotated to be parallel to a floor surface;

FIG. 7 is a partially enlarged sectional, explanatory view showing a connecting portion between the rotary bend and the rotary pipe of FIG. 4;

FIG. 8(*a*) is a sectional view taken along the line VIII—VIII of FIG. 7, and FIG. 8(*b*) is a view seen from a position indicated by arrow A in FIG. 8(*a*);

FIG. 9 is a sectional, explanatory view showing an exhaust channel in an interior of the electric vacuum cleaner body of FIG. 1;

FIG. 10 is a partially enlarged view of a proximity of a side portion of the electric vacuum cleaner body of FIG. 1;

FIG. 11 is a partially enlarged view of a proximity of an upper portion of the electric vacuum cleaner body of FIG. 1;

FIG. 12 is an explanatory view showing a condition in which the vacuum cleaner body of FIG. 1 is used in a handy condition;

FIG. 13 is an explanatory view showing a condition in which the vacuum cleaner of FIG. 1 is used after transforming to a condition in which the vacuum cleaner body is removed from the support pipe;

FIGS. 14(*a*) and 14(*b*) are sectional, explanatory views along an axial direction of the support pipe showing a method of fitting between the support pipe and the rotary bend of FIG. 1;

FIGS. 15(*a*) and 15(*b*) are sectional, explanatory views along a radial direction of the support pipe showing a method of fitting between the support pipe and the rotary bend of FIG. 1, wherein FIG. 15(*a*) shows a condition after fitting and FIG. 15(*b*) shows a condition immediately before the fitting;

FIG. 16 is a sectional, explanatory view showing a condition immediately before the clamping hook of FIG. 4 is fitted to an upward facing concave portion;

FIG. 17 is a front view showing the electric vacuum cleaner of FIG. 1 in the upright condition for use;

FIG. 18 is a partially enlarged view showing a condition where a crevice nozzle is attached to the rear side of the support pipe of FIG. 1;

FIG. 19 is a partially enlarged, front view of the grip of FIG. 1,

FIG. 20 is a sectional view taken along the line VII—VII of FIG. 19; and FIG. 21 is a side view of a conventional electric vacuum cleaner.

DETAILED DESCRIPTION

The electric vacuum cleaner of the present invention will now be explained in detail with reference to the drawings.

The electric vacuum cleaner of the present invention is an electric vacuum cleaner of concurrent type which can be used in an upright condition for use (see FIG. 1), in a condition where the vacuum cleaner body 1 is detached from the support pipe 2 (see FIG. 13), and in a handy condition where only the vacuum cleaner body 1 is used (see FIG. 12), by making a vacuum cleaner body 1 to be detachably fixed to a support pipe 2.

The electric vacuum cleaner shown in FIGS. 1 to 8 comprises a vacuum cleaner body 1, a support pipe 2, a rotary bend 3, a rotary pipe 4, a suction device 5, and a hose 6 for connecting an upper end opening 2*a* of the support pipe 2 with a suction inlet 1*a* of the vacuum cleaner body 1. The suction device 5 is provided with running wheels W, and in the above described upright condition for use, running of the electric vacuum cleaner is enabled by these running wheels W.

A grip 7 to be held by a users hand is fastened to an upper portion of the support pipe 2.

Figure 2:
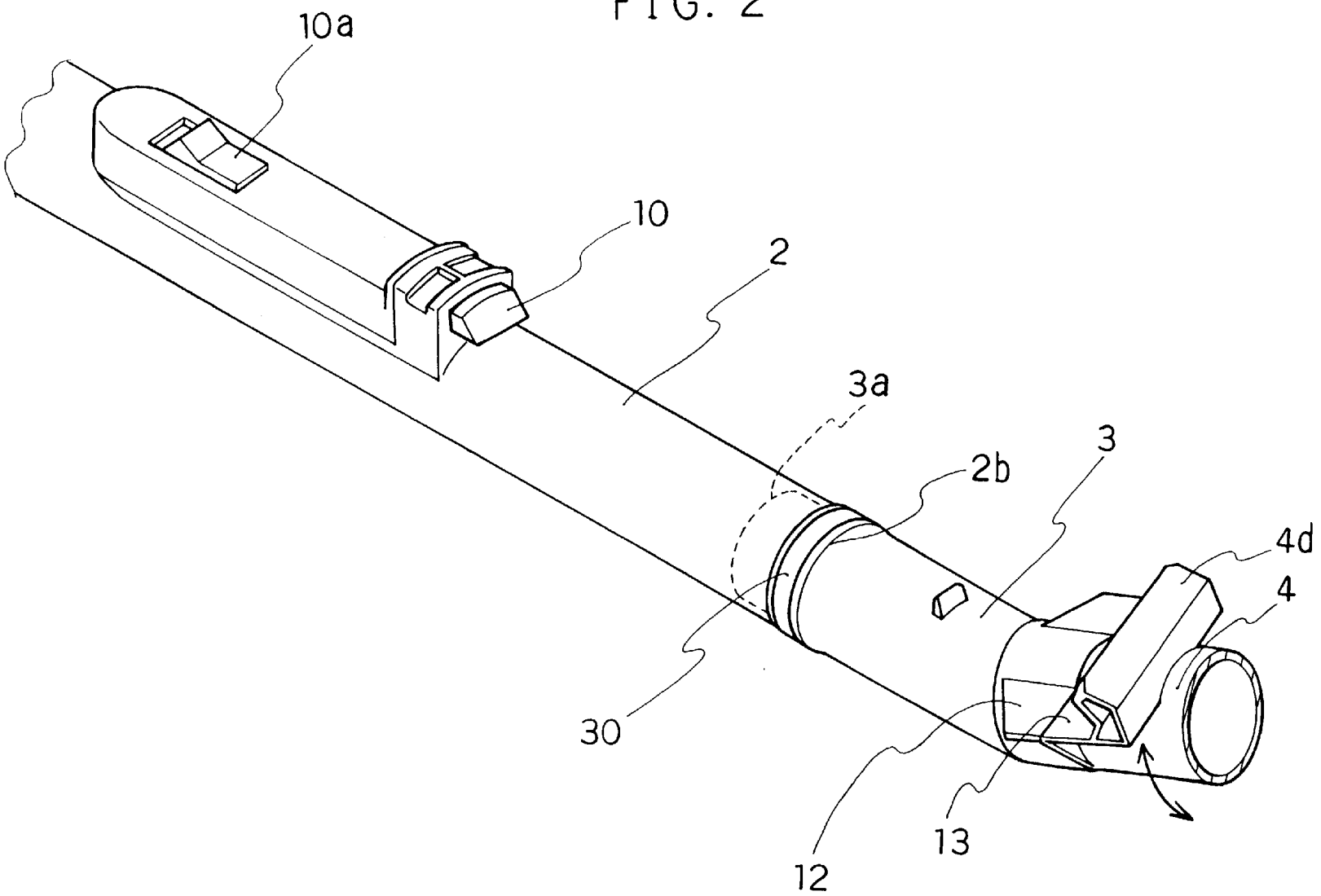
FIG. 2 is a partially enlarged, perspective view showing the support pipe, rotary bend and rotary pipe of FIG. 1.

As shown in FIG. 2, an upper end opening 3*a* of the rotary bend 3 is connected to a lower end opening 2*b* of the support pipe 2. The support pipe 2 and the rotary bend 3 are connected to each other in a attachable/detachable manner as not to be rotatable by means of a C-ring 30 to be described later (see FIG. 15).

As shown in FIG. 7, an upper end opening 4*a* of the rotary pipe 4 is connected to a lower end opening 3*b* of the rotary bend 3 in a rotatable manner. The rotary bend 3 and the rotary pipe 4 are connected to each other so as to be rotatable but not to be detachable by means of a locking piece 8 (see FIG. 8). More particularly, a circumferential groove 4*b* (see FIGS. 7 and 8) is formed at a circumferential surface in an upper portion of the rotary pipe 4. On the other hand, a pair of opposing rectangular openings 3*c* are provided in a lower portion of the rotary bend 3. The rotary bend 3 and the rotary pipe 4 are connected to each other so as to couple the above groove 4*b* and the rectangular openings 3*c* (see FIG. 8(*b*)), and thereafter, the locking piece 8 is fitted to the rectangular openings 3*c* in such a manner that a tongue piece 8*a* of the locking piece 8 is arranged in the interior of the groove 4*b*. With this arrangement, the rotary bend 3 and the rotary pipe 4 are connected to each other as to be rotatable but not to be detachable.

As shown in FIGS. 4 and 5, the suction device 5 is connected to a lower end opening 4*c* of the rotary pipe 4. The suction device 5 is connected thereto so as not to be rotatable with respect to an axial direction of the rotary pipe 4. In this embodiment, a hollow rotary shaft 9 is fastened to the lower end opening 4*c* of the rotating pipe 4, and both ends of the rotary shaft 9 are connected to a rear portion of the suction device 5 in a rotatable manner. With this arrangement, the rotary pipe 4 is enabled to move around the rotary shaft 9 with respect to the suction device 5.

Figure 3:
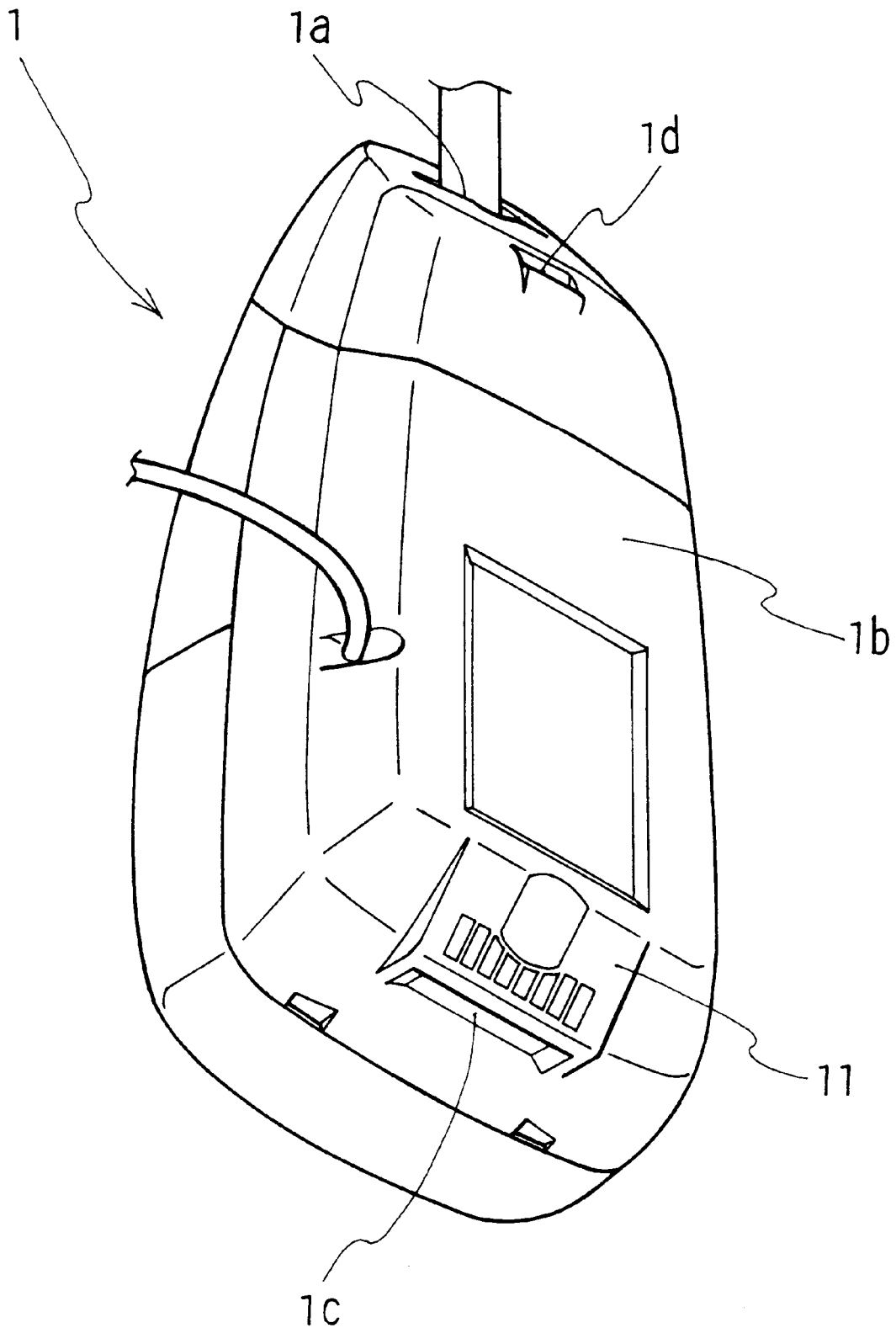
FIG. 3 is a perspective view showing a lower surface of the electric vacuum cleaner of FIG. 1 seen from behind.

As shown in FIGS. 2 to 4, a lower surface 1*b* of the vacuum cleaner body 1 can be fastened to the outer surface of the support pipe 2 in a detachable manner. The method of fixing according to this embodiment is as follows: a downward facing concave portion 1*c* (a first receiving portion) of FIG. 3 formed at a rear end of the lower surface 1*b* of the vacuum cleaner body 1 is fitted to an upward facing convex portion 4*d* (a first engaging portion) of FIG. 2 provided to the rotary pipe 4, whereby a condition of FIG. 4 is assumed. Then, by making the vacuum cleaner body 1 abut against the support pipe 2, a downward facing clamping hook 10 of FIG. 2 provided to the support pipe 2 is fitted to an upward facing concave portion 1*d* (a second receiving portion) of FIG. 3 formed at a front end of the lower surface 1*b* of the vacuum cleaner body 1. In this manner, the lower surface 1*b* of the vacuum cleaner body 1 can be fastened to the outer surface of the support pipe 2 as shown in FIG. 1.

As shown in FIG. 16, the clamping hook 10 comprises a releasing pinch 10*a* and a claw portion 10*b* (a second engaging portion) that are linked by a pair of linking plates 10*c*.

The pair of linking plates 10*c* are arranged to be respectively parallel to the compression coil spring 51 in a manner as to sandwich the compression coil spring 51 from vertical directions in FIG. 16. Further, an upper end of the compression coil spring 51 abuts against a spring stopper 52 fastened to the support pipe 2. The spring stopper 52 is arranged between the pair of linking plates 10*c*.

The clamping hook 10 can move up and down in an interior of a cover 53 fastened to the support pipe 2.

When transforming the electric vacuum cleaner according to this embodiment into the upright condition for use, the downward facing concave portion 1*c* at the rear end of the vacuum cleaner body 1 is first fitted to the upward facing convex portion 4*d* at the rotary pipe 4 as shown in FIG. 4.

Thereafter, the vacuum cleaner body 1 is rotated with a point at which the concave portion 1*c* and the convex portion 4*d* are fitted being as a fulcrum, and the upward facing concave portion 1*d* at the front end of the vacuum cleaner body 1 is fitted to the clamping hook 10 of the support pipe 2.

In this embodiment, a slanting surface 10*d* which is inclined in an upward direction with receding from the support pipe 2 is formed on the claw portion 10*d* of the clamping hook 10 as shown in FIG. 16. Thus, by simply rotating the vacuum cleaner body 1 to a direction in which it abuts against the support pipe 2, an end edge 1*f* of the concave portion 1*d* of the vacuum cleaner body 1 pushes the clamping hook 10 up while contacting the slanting surface 10*d*, and thereafter, when the entire claw portion 10*b* has got over the end edge 1*f*, it will fall into the interior of the concave portion 1*d*. Consequently, fitting of the concave portion 1*d* and the clamping hook 10 can be easily performed. It should be noted that while the present embodiment has been explained by taking an example in which a slanting surface 10*d* is provided, the present invention is not limited to this, and fitting of the concave portion 1*d* and the clamping hook 10 can be performed also without the slanting surface 10*d* but by manually operating the releasing pinch 10*a* up and down.

Moreover, since the clamping hook 10 is energized downward by the compression coil spring 51 in this embodiment, the fitting of the concave portion 1*d* and the clamping hook 10 can be made even firmer. It should be noted that while the present embodiment has been explained by taking an example in which a compression coil spring 51 is employed as an example of an energizing means for energizing the clamping hook 10 downward, the present invention is not limited to this, and an elastic member such as rubber might be employed as an alternative energizing means to make the fitting of the concave portion 1*d* and the clamping hook 10 even firmer. It should be further noted that fitting of the concave portion 1*d* and the clamping hook 10 can also be performed by drop of the clamping hook 10 by its own weight, without providing an energizing means.

Next, detaching the vacuum cleaner body 1 from the support pipe 2 can be performed by carrying out the processes as described above in a reverse way, that is, the clamping hook 10 is drawn out from the concave portion 1*d* by sliding the releasing pinch 10*a* of the clamping hook 10 upward and performing detachment by the remaining processes in a reverse way. Therefore, since fitting and separation of the concave portion 1*c* and the convex portion 4*d* as well as the concave portion 1*d* and the clamping hook 10 can be sequentially performed point by point, attaching/detaching of the vacuum cleaner body 1 can be easily performed.

When pushing the clamping hook 10 up for detaching the vacuum cleaner body 1 from the support pipe 2, the vacuum cleaner body 1 is likely to tumble in a direction apart from the support pipe 2 with a position of the concave portion 1*c* at the rear end fitting to the upward facing convex portion 4*d* being as a fulcrum. However, since the hose retainer 49 for fixing the hose 6 connecting the vacuum cleaner body 1 and the support pipe 2 to the support pipe 2 is arranged at a higher position than the clamping hook 10 as shown in FIG. 1, tumbling of the vacuum cleaner body 1 can be prevented by the tension of the hose 6 after fixing the hose 6 to the support pipe 2 by means of the hose retainer 49.

A rotation locking mechanism 14 is shown in FIGS. 2 to 5 which is the rotation locking means according to this embodiment for locking the rotation of the rotary bend 3 with respect to the rotary pipe 4 when the vacuum cleaner body 1 is abutted against the rotary pipe 4 at the specified position. This rotation locking mechanism 14 comprises a flat portion 11 formed on the lower surface 1*b* of the vacuum cleaner body 1, a flat portion 12 formed in the proximity of the connecting portion between the rotary pipe 4 and the rotary bend 3 on the outer surface of the rotary bend 3, and a flat portion 13 formed in the proximity of the flat portion 12 of the rotary bend 3 on the outer surface of the rotary pipe 4.

As shown in FIG. 2, at least a part of the flat portion 12 of the rotary bend 3 and the flat portion 13 of the rotary pipe 4 are made to project from the circumferential surface of the rotary bend 3 or the rotary pipe 4 along a tangential direction of the circumferential surface, the surface areas of the flat portions 12, 13 are made wide. Therefore, these can more easily and reliably contact the flat portion 11 on the side of the vacuum cleaner body 1.

When transforming the electric vacuum cleaner of the above described arrangement into the upright condition for use, the vacuum cleaner body 1 is made to abut against the rotary pipe 4 at the specified position by engagement between the concave portion 1*c* and the convex portion 4*d*. By this operation, both the flat portion 12 of the rotary bend 3 and the flat portion 13 of the rotary pipe 4 are made to abut against the flat portion 11 on the side of the vacuum cleaner body 1, whereby the rotation between the rotary pipe 4 and the rotary bend 3 can be locked.

Therefore, the support pipe 2 and rotary bend 3 cannot be inclined as to rotate with respect to the suction device 5. Consequently, no force in a rotating direction is applied to an users hand holding the grip 7 on the upper portion of the support pipe 2.

Even in a case where the rotary bend 3 is at a somewhat distorted position with respect to the rotary pipe 4, this distortion is automatically corrected, since the rotary bend 3 faces to the front such that the flat portion 12 is parallel to the flat portion 11 on the side of the vacuum cleaner body 1 when making the vacuum cleaner body 1 abut against the rotary pipe 4. The clamping hook 10 can thus be easily fitted to the upward facing concave portion 1*d* on the upper surface of the vacuum cleaner body 1.

On the other hand, when transforming to a condition where the vacuum cleaner body 1 is detached from the support pipe, detaching the vacuum cleaner body 1 from the rotary pipe 4 at the specified position causes the flat portions 12, 13 to separate from the flat portion 11, whereby the rotation locking condition between the rotary pipe 4 and rotary bend 3 is released to enable free rotation (see FIGS. 5(*a*), (*b*)).

Therefore, when rotating the rotary bend 3 by approximately 90 degrees as to be parallel to the floor surface as shown in FIG. 5(*b*) in a condition where the vacuum cleaner body is detached from the support pipe, a full-flat condition as shown in FIG. 6 is assumed and the suction device 5 can be inserted into narrow spaces such as under a bed.

It should be noted that while the present embodiment has been explained by taking an example in which the rotation locking mechanism 14 comprising the flat portions 11, 12 and 13 is employed as the rotation locking means for locking rotation between the rotary bend 3 and the rotary pipe 4 in the upright condition for use, the present invention is not limited to this, and it goes without saying that a rotation locking means of another type might also be employed.

An alternative type rotation locking means might be a type in which projections are formed on the rotary bend 3 and the rotary pipe 4 which are fitted to concave portions formed on the vacuum cleaner body 1.

In the electric vacuum cleaner according to this embodiment, improvements have been made in that exhausted gas from the side surface of the vacuum cleaner body is not directed to the user in any of the upright condition for use (see FIG. 1), in the condition where the vacuum cleaner body is detached from the support pipe (see FIG. 13), or in the handy condition (see FIG. 12) as shown in FIGS. 9 to 13.

There has been conventionally known electric vacuum cleaners which are capable of being used in two conditions, that is, (1) an electric vacuum cleaner which can be concurrently used in an upright condition and in a handy condition, and (2) an electric vacuum cleaner which can be concurrently used in an upright condition and in a condition where the vacuum cleaner body is detached from the support pipe. Both of them are provided with exhaust outlets at proper positions to exhaust gas into proper directions. In the case of (1), the exhaust outlet is provided on the side surface on the upper portion of the vacuum cleaner when in the upright condition for use, wherein exhausted gas is directed to the user, and in the case of (2), the exhaust outlet is provided on the front surface on the lower portion of the vacuum cleaner body, wherein exhausted gas is directed to the side opposite to the user.

However, it has not been known for an electric vacuum cleaner which can be used in three conditions as that of this embodiment, has not been known. Further, applying either of the exhaust outlets of case (1) or (2) would cause inconveniences that, in at least one of the three conditions for use, the user would be exposed to exhausted gas or exhausted gas would fling up dust.

In order to solve these problems, the exhaust outlet 21 of the vacuum cleaner body 1 according to his embodiment is of slit-type which is inclined diagonal-rearward when seen from the side of the vacuum cleaner body 1 as shown in FIGS. 10, 12 and 13, and a section of the vacuum cleaner body seen from the upper surface side of the vacuum cleaner body 1 (a horizontal section of the vacuum cleaner body 1) is open to diagonal-frontward with respect to the vacuum cleaner body 1 as shown in FIG. 9.

Moreover, the exhaust channel in the interior of the vacuum cleaner body 1 is so arranged as shown in FIG. 9 that exhausted gas is once sent to the rear of the vacuum cleaner body 1 from rearward of a motor 22 and exhausted from the side in a winding manner.

As shown in FIG. 9, exhausted gas which is exhausted from the motor 21 is made to flow rearward of the motor 22 (i.e. downward in FIG. 9), separated into two directions and made to flow to a spaced portion 24 lying between an outer wall 1e of the vacuum cleaner body 1 and a rib (separating wall) 23 provided between the outer wall 1*e* and the motor 22. The exhausted gas is turned over in the spaced portion 24 and is exhausted to diagonal-frontward (diagonal-upward in FIG. 9). Thereafter, exhausted gas is guided diagonal-frontward at a specified angle by a guide rib 25 of a diagonal-forward inclined shape and the slit-shaped exhaust outlet 21.

As shown in FIG. 10, the slit-shaped exhaust outlet 21 is open in a diagonal-frontward inclined shape when seen from the side of the vacuum cleaner body 1, whereby exhausted gas is exhausted to diagonal-upward as indicated by arrow B.

Thus, the user who is on the right-hand side with respect to the vacuum cleaner in FIG. 10 will not be exposed to exhausted gas in the upright condition for use shown in FIGS. 10 and 11 so that the vacuum cleaner can be comfortably used without flinging up any dust on the floor surface.

In the handy condition of FIG. 12, the vacuum cleaner body 1 is used in a condition where the suction inlet 1*a* is facing downward, but the user who is on the right-hand side with respect to the vacuum cleaner body 1 in FIG. 12 would not be exposed to exhausted gas so that the vacuum cleaner can be comfortably used without flinging up any dust on the floor surface.

Further, in the condition where the vacuum cleaner body is detached from the support pipe as shown in FIG. 13, the vacuum cleaner body 1 is used in a condition where the suction inlet la is directed horizontally, but the user who is on the right-hand side with respect to the vacuum cleaner body 1 in FIG. 13 would not be exposed to exhausted gas so that the vacuum cleaner can be comfortably used without flinging up any dust on the floor surface.

It should be noted that the number of parts can be decreased by integrally forming the exhaust outlet 21 for guiding direction of exhausted gas with the vacuum cleaner body 1 (especially on the lower portion in FIG. 9).

The present embodiment is further arranged in that a C-ring 30 is employed as a bend setting ring for enabling easy attaching/detaching between the support pipe 2 and the rotary bend 3, between other pipes or between a pipe and a hose as shown in FIGS. 2, 14 and 15, wherein the C-ring 30 is always fitted to a groove 25 formed on the surface of the support pipe 2.

In the present embodiment, a C-ring 30 which is a ring applied with a so-called C cut is employed as shown in FIGS. 14 and 15. By abutment of the rotary bend 3 against the C-ring 30 when the rotary bend 3 is fitted to the support pipe 2, the C-ring 30 is once lifted in an automatic manner from the surface of the support pipe 2 and is enabled to perform a returning action by elasticity (spring characteristics) of the C-ring 30.

Moreover, the C-ring 30 is so arranged that the C-ring 30 is always fitted to the interior of the groove 25 formed on the outer surface of the support pipe 2. The inner surface side of the C-ring 30 is provided with a convex portion 30*a* which projects into the interior of the support pipe 2 through a hole 25*a* formed on the bottom surface of the groove 25. Therefore, when fitting the rotary bend 3 to the support pipe 2, the convex portion 30*a* can be caught by the groove 25 as shown in FIG. 15(*b*) even if the C-ring 30 is once lifted from the surface of the support pipe 2, whereby the C-ring 30 is prevented from falling from the support pipe 2.

By the above described arrangement of the C-ring 30 and the groove 25, when performing fitting of the rotary bend 3 to the support pipe 2, the rotary bend 3 might be simply inserted into the support pipe 2 from a condition shown in FIG. 14(*a*) without touching the C-ring 30. That is, by the convex portion 30*a* pressing to the outer surface of the rotary bend 3, the C-ring 30 is once lifted from the surface of the support pipe 2 (see FIG. 15(*b*)), and thereafter, the C-ring 30 is returned onto the surface of the support pipe 2 by elasticity thereof while the convex portion 30*a* fits to the rotary bend 3*e*, whereby fitting between pipes can be performed without gripping the C-ring 30 by hand.

On the other hand, when removing the rotary bend 3 from the support pipe 2, the C-ring 30 is pinched by hand, and the concave portion 30*a* is caught at the interior of the groove 25 as described above, which enables detachment of the rotary bend 3 without the C-ring 30 completely being detached from the support pipe 2.

In the electric vacuum cleaner shown in FIGS. 1 and 4, the lower surface 1*b* of the vacuum cleaner body 1 is fixed to the front side of the support pipe 2 in a freely detachable manner by a fixing method which will be described later. Further, the upper end opening 2*a* of the support pipe 2 is formed on the front side of the support pipe 2. The hose 6 connecting between the vacuum cleaner body 1 and the support pipe 2 is arranged on the front side of the support pipe 2 over its full length. Due to this arrangement, the hose 6 does not contact the user in the rear side of the support pipe 2 in the upright condition for use of FIG. 1, whereby operation is made easy.

As shown in FIG. 1, at least a part of the upper portion of the support pipe 2, for instance, a bent portion 2*b* in the upper portion of the support pipe 2, is bent to the front side of the support pipe, and the upper end opening 2*a* is formed on the upper end of the bend portion 2*b* of the support pipe 2, the hose 6 to be connected to the upper end opening 2*a* can still further be receded from the user, which enables easier operation.

Moreover, since a grip 7 is fixed to the rear side of the bent portion 2*b*, the grip 7 can be easily held by hand and can further be easily operated.

Further, as shown in FIG. 17, the electric vacuum cleaner according to this embodiment is so arranged that the hose 6 is provided as to be symmetrical with respect to the vacuum cleaner body 1 and the support pipe 2 when seen from the front of the electric vacuum cleaner in FIG. 17, there are no differences in operability between a right-handed person and a left-handed person.

Moreover, since the electric vacuum cleaner according to this embodiment is so arranged that internal components of the vacuum cleaner body 1 such as motor 22 which might influence weight balance are also arranged symmetrically when seen from the front of the electric vacuum cleaner as shown in FIG. 9, there are no differences in operability between a right-handed person and a left-handed person It should be noted that numeral 21 in FIG. 9 denotes an exhaust hole formed in the outer wall 1*e* of the vacuum cleaner body 1, 23 a rib, 24 a spaced portion and 25 a rib for changing the flow of exhausted gas.

As shown in FIGS. 1 and 18, the electric vacuum cleaner of the present embodiment also has improvements in an accommodation portion of attachments for efficiently utilizing the available space.

Attachments such as a crevice nozzle have conventionally been accommodated into housing portions formed by denting the rear portion of the vacuum cleaner body or by attaching a separated housing of ring-shape or cylindrical-shape to the vacuum cleaner body or to the proximity of the grip. However, when accommodating them into the rear portion of the vacuum cleaner body, the accommodating position of the attachments will be low, which is troublesome since the user needs to squat down each time attachments are to be attached/detached. On the other hand, in the latter case, addition of a separate element for accommodation would be necessary and would also require additional space.

By the arrangement of accommodating attachments such as crevice nozzle 43 in a space between a pair of opposing card racks 41*a*, 41*b* provided in the rear side of the support pipe 2 for winding up a power supply card 42 as shown in FIGS. 1 and 8, space can be efficiently utilized. An additional element for fixing the attachments can be eliminated and provision of the attachments accommodating portion close to the grip 7 enables easy operation.

As shown in FIG. 18, by engaging a lower end of the crevice nozzle 43 to a triangle rib 44 projecting upward from the card rack 41*b* and by fitting a semi-spherical projection 45 projecting from both sides of an upper end of the crevice nozzle 43 into a hole 44*a* of a triangle rib 44 projecting downward from the card rack 41*a*, the crevice nozzle 43 can be accommodated between the card racks 41*a*, 41*b*. Further, by providing ribs 46, 47 on the outer surface of the support pipe 2 located between the card racks 41*a*, 41*b*, space can be secured between the crevice nozzle 43 and the support pipe 2 which enables it to easily detach the crevice nozzle 43.

When using the electric vacuum cleaner in the upright condition for use as shown in FIG. 1, the power supply card 42 is used by untying it from the card racks 41*a*, 41*b*. At this time, the power supply card 42 might be disturbing when extending in the proximity of the users feet. In the present embodiment, by making the power supply card 42 engage with the grip 7 in a attachable/detachable manner, the power supply card 42 would not disturb the user. More particularly, at least a pair of claw portions 48 are provided in an opposing manner in the interior of the grip 7 for holding the power supply card 42. By engaging the power supply card 42 with the claw portions 48, the power supply card 42 draws a loop and reaches the ground with the grip 7 being the start point as shown by the two-dot chain line of FIG. 1, whereby the feet of the user are not disturbed and easy operation is enabled. It should be noted that the claw portions 48 might be provided as a different member from the grip 7.

According to the present invention, the suction device is provided with running wheels, and the vacuum cleaner body is made to run by using these wheels of the suction device in a condition where the vacuum cleaner body is attached to the support pipe, whereby the cleaning workability can be improved. Further, the external appearance of the vacuum cleaner body in a condition of being detached from the support pipe can be improved.

In the upright condition for use, the rotary bend which receives the load of the vacuum cleaner body is prevented from rotating relative to the rotary pipe on the side of the suction device, whereby no force in a rotating direction is applied to the users hand holding the grip, and operation is made easy.

Moreover, by enabling rotation between the rotary bend and the rotary pipe in the condition where the vacuum cleaner body is detached from the support pipe, the suction device can be inserted into narrow spaces such as under a bed so that the sphere of usage is not limited.

Further, according to the present invention, attaching/detaching of the vacuum cleaner body to/from the support pipe is made easy whereby operation is made by far easier.

By arranging the position of the hose retainer higher than the upper engagement position of the vacuum cleaner body and the support pipe, stability of the vacuum cleaner body during the attaching/detaching processes of the vacuum cleaner body can be improved.

Further, according to the present invention, the hose would not contact the user and can be smoothly used in the upright condition for use. Since the hose would not contact the user, the user would also not feel uncomfortable and is able to comfortably perform cleaning.

What is claimed is:

1. An electric vacuum cleaner comprising a vacuum cleaner body, a hose to be connected to the vacuum cleaner body, a support pipe to be connected to the hose, and a suction device to be connected to the support pipe, wherein the suction device is provided with running wheels, and the vacuum cleaner body is able to be detachably fastened to the support pipe so that the vacuum cleaner body is supported by the wheels of the suction device when the vacuum cleaner body is attached to the support pipe.

2. An electric vacuum cleaner comprising a vacuum cleaner body, a hose to be connected to the vacuum cleaner body, a support pipe to be connected to the hose, a rotary pipe to be connected to the support pipe in a rotatable manner, and a suction device to be connected to the rotary pipe, wherein the vacuum cleaner body is arranged such that the vacuum cleaner body can be fastened to the support pipe in a detachable manner, the vacuum cleaner body is further arranged such that the vacuum cleaner body can be fastened to the rotary pipe in a detachable manner, and wherein the electric vacuum cleaner is provided with a rotation locking means for preventing rotation of the rotary pipe with respect to the support pipe when the vacuum cleaner body is attached to the support pipe.

3. An electric vacuum cleaner comprising:

(a) a vacuum cleaner body, (b) a support pipe connected to a suction inlet of the vacuum cleaner body, (c) a rotary bend connected to the support pipe, (d) a rotary pipe connected to the rotary bend in a rotatable manner, and (e) a suction device connected to the rotary pipe, wherein the vacuum cleaner body is attached to the support pipe in an attachable/detachable manner, the vacuum cleaner body is attached to the rotary pipe in an attachable/detachable manner, and wherein the electric vacuum cleaner further includes a rotation locking mechanism which prevents rotation of the rotary bend with respect to the rotary pipe when the vacuum cleaner body is attached to the rotary pipe at a predetermined position.

4. The electric vacuum cleaner of claim 3, wherein the rotation locking means comprises a flat portion formed on the vacuum cleaner body, a flat portion formed on the rotary bend, and a flat portion formed on the rotary pipe.

5. The electric vacuum cleaner of claim 4, wherein the rotary bend includes a circumferential surface, and at least a part of the flat portion of the rotary bend is so formed as to project from the circumferential surface of the rotary bend along a tangential direction of the circumferential surface.

6. The electric vacuum cleaner of claim 4, wherein at least a part of the flat portion of the rotary pipe is so formed as to project from a circumferential surface of the rotary pipe along a tangential direction of the circumferential surface.

7. The electric vacuum cleaner of claim 3, wherein the rotation locking means comprises projections formed on the rotary bend and the rotary pipe, and concave portions formed on the vacuum cleaner body for fitting with the projections.

8. An electric vacuum cleaner comprising a vacuum cleaner body having a front portion and a rear portion opposite to said front portion, a hose to be connected to the vacuum cleaner body, a support pipe to be connected to the hose, said support pipe having a first end and a second end opposite said support pipe first end, wherein the support pipe second end is connected to a rotary pipe which is provided with a first engaging portion which detachably engages with a first receiving portion formed in the rear portion of the vacuum cleaner body, and said support pipe is provided with a second engaging portion which detachably engages with a second receiving portion formed in the front portion of the vacuum cleaner body.

9. The electric vacuum cleaner of claim 8, wherein the second engaging portion of the support pipe is movable toward said first and second ends of said support pipe.

10. The electric vacuum cleaner of claim 9, wherein a tip portion of the second engaging portion of the support pipe is formed with a slanting surface that is inclined so as to extend away from the support pipe as it extends in a direction from said support pipe second end towards said support pipe first end.

11. The electric vacuum cleaner of claim 9, wherein the electric vacuum cleaner includes an energizing means that biases the second engaging portion of the support pipe in a direction from said support pipe first end towards said support pipe second end.

12. An electric vacuum cleaner comprising a vacuum cleaner body, a hose to be connected to the vacuum cleaner body, a support pipe to be connected to the hose, said support pipe having a first side and a second side opposite said first side, and a suction device to be connected to the support pipe, wherein the vacuum cleaner body is detachably fastened to the first side of the support pipe, and wherein the hose is connected to the vacuum cleaner body and said support pipe such that the hose does not extend to the second side of the support pipe.

13. The electric vacuum cleaner of claim 12, wherein at least a part of an upper portion of the support pipe is bent to the first side of the support pipe, said bent portion having a first end and a second end opposite said first end, and an opening is formed at the first end of the bent portion of the support pipe.

14. The electric vacuum cleaner of claim 13, wherein a grip is fastened to the bent portion of the support pipe so as to extend toward said second side of said support pipe.

15. The electric vacuum cleaner of claim 1, wherein said vacuum cleaner body does not have wheels.

16. The electric vacuum cleaner of claim 8, wherein the first and second engaging portions as well as the first and second receiving portions are configured such that said first and second engaging portions are capable of being sequentially engaged with, and sequentially detached from, said first and second receiving portions, respectively.

17. An electric vacuum cleaner of claim 8, further comprising a suction device connected to said rotary pipe.

18. The electric vacuum cleaner of claim 12, wherein a grip is fastened to the support pipe so as to extend toward said second side of said support pipe.

19. The electric vacuum cleaner of claim 12, further comprising a hose retainer attached to said first side of said support pipe so that when said hose is in said hose retainer, said hose does not extend to said second side of said support pipe.

* * * * *